US007032391B2

(12) United States Patent
Tremblay et al.

(10) Patent No.: US 7,032,391 B2
(45) Date of Patent: Apr. 25, 2006

(54) METHOD AND DEVICE FOR STIRRING WATER DURING ICEMAKING

(75) Inventors: Dennis D. Tremblay, Geneva, IL (US); Michael DuHack, Indianapolis, IN (US); Laurence S. Slocum, Mooresville, IN (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/895,665

(22) Filed: Jul. 21, 2004

(65) Prior Publication Data

US 2006/0016207 A1 Jan. 26, 2006

(51) Int. Cl.
*F25C 1/04* (2006.01)

(52) U.S. Cl. ..... 62/68; 62/351

(58) Field of Classification Search ..... 62/68, 62/71, 73, 351, 353

See application file for complete search history.

(56) References Cited

U.S. PATENT DOCUMENTS

| | | | |
|---|---|---|---|
| 2,109,822 | A | 3/1938 | Eddy |
| 2,514,942 | A | 7/1950 | Eaton |
| 2,756,567 | A | 7/1956 | Martin |
| 3,027,731 | A | 4/1962 | Lindenberg et al. |
| 3,029,609 | A | 4/1962 | Zearfoss, Jr. |
| 3,299,656 | A | 1/1967 | Linstromberg et al. |
| 3,396,552 | A | 8/1968 | Buchser |
| 3,418,823 | A | 12/1968 | Vivai |
| 3,433,030 | A | 3/1969 | Jacobs |
| 3,620,497 | A | 11/1971 | Schaff |
| 4,045,979 | A | 9/1977 | Mazzini |
| 4,207,750 | A | 6/1980 | Simkins |
| 4,429,550 | A | 2/1984 | Latter |
| 4,487,024 | A | 12/1984 | Fletcher et al. |
| 4,573,325 | A | 3/1986 | Chiu et al. |
| 4,685,304 | A | 8/1987 | Essig |
| 4,727,720 | A | 3/1988 | Wernicki |
| 4,923,494 | A | 5/1990 | Karlovits |
| 4,966,004 | A | 10/1990 | Midlang et al. |
| 5,038,573 | A | 8/1991 | McAllister |
| 5,129,237 | A | 7/1992 | Day et al. |
| 5,182,916 | A | 2/1993 | Oike et al. |

(Continued)

*Primary Examiner*—William E. Tapolcai
(74) *Attorney, Agent, or Firm*—Maginot, Moore & Beck

(57) ABSTRACT

An icemaker assembly includes an ice tray has at least one ice forming compartment and an ice ejector having at least one ejector member. The ice ejector is operable to (i) stir water located within the at least one ice forming compartment with the at least one ejector member during a first mode, and (ii) urge ice out of the at least one ice forming compartment with the at least one ejector member during a second mode. A method of making ice comprises an operating an ice ejector of an icemaker in a first mode of operation step and an operating an ice ejector of an icemaker in a second mode of operation step. During the first mode of operation step, a plurality of ejector members of the ice ejector are respectively advanced through water located within a plurality of compartments of an ice tray of the ice maker during cooling of the water in the ice tray. In the second mode of operation step, the plurality of ejector members are respectively advanced into contact with ice formed within the plurality of ice forming compartments so that the ice is urged out of the plurality of ice forming compartments.

20 Claims, 15 Drawing Sheets

U.S. PATENT DOCUMENTS

| | | | |
|---|---|---|---|
| 5,619,858 | A | 4/1997 | Gunderson et al. |
| 5,922,030 | A | 7/1999 | Shank et al. |
| 6,067,806 | A | 5/2000 | Park |
| 6,092,374 | A | 7/2000 | Kang et al. |
| 6,357,720 | B1 | 3/2002 | Shapiro et al. |
| 6,401,461 | B1 | 6/2002 | Harrison et al. |
| 6,513,337 | B1 | 2/2003 | Astvatsatrian et al. |
| 2001/0039802 | A1 | 11/2001 | Barrash |
| 2001/0039824 | A1 | 11/2001 | Newman et al. |
| 2003/0010053 | A1 | 1/2003 | Kim et al. |
| 2005/0072166 | A1* | 4/2005 | Lee et al. ..... 62/135 |

* cited by examiner

METHOD AND DEVICE FOR STIRRING WATER DURING ICEMAKING

CROSS REFERENCE

Cross reference is made to co-pending U.S. patent applications Ser. No. 10/895,792, entitled Method and Device for Eliminating Connecting Webs between Ice Cubes and Ser. No. 10/895,570, entitled Method and Device for Producing Ice Having a Harvest-facilitating Shape, which are assigned to the same assignee as the present invention, and which are filed concurrently herewith, the disclosures of which are hereby incorporated by reference in their entirety.

BACKGROUND AND SUMMARY

This disclosure relates generally to icemakers for household refrigerators and more particularly to such ice makers having an ejection arm that is extendable into the ice making cavity.

Refrigerators with ice makers are a popular consumer item, and most side-by-side refrigerator/freezers have icemakers installed as standard items or are wired to accommodate an add-on ice maker. In a typical refrigerator/freezer with an icemaker, water is introduced into ice forming compartments in an ice tray and allowed to freeze to form ice cubes.

Typically, water is allowed to flow into the ice tray until each of the compartments is filled to a desired level. The water is then allowed to stand in the tray until it freezes. The freezing point of pure water is commonly identified as 32 degrees Fahrenheit (0 degrees Celsius), but water purity, air pressure and other parameters can alter the freezing point. As the water in the cavity is cooling, it is possible for temperatures to vary in different portions of the water, i.e. the water in the ice forming compartments includes a temperature gradient or is otherwise not in an isothermal state.

Various factors contribute to the non-isothermal state of the water in the ice forming compartments. Typically prior to each ejection cycle, a heater heats the tray to induce the ice tray to expand to facilitate the ejection process. To induce this expansion the temperature of the tray must be increased often several degrees above freezing. After ejection of the ice, new fill water at a temperature above the freezing point is added to the tray. While the air temperature in the freezer compartment typically remains well below freezing throughout the ejection and refilling process, the temperature of the ice tray, as a result of heating with the heater and contact with the liquid water is at least initially above the freezing point of water during the beginning of an ice making cycle. As a result, a temperature gradient may be created in the water in the ice tray with the water adjacent the surface being colder than the water adjacent the tray. Thus, the surface of the water often freezes first.

Once the surface freezes, the surface ice acts as an insulation layer that buffers the temperature of the water adjacent thereto at or close to freezing. The tray however remains in contact with the air of the freezer compartment which is well below the freezing point of water. Thus, by convection cooling the water adjacent the tray begins to cool faster than the water adjacent the surface ice. Thus, the water adjacent or in contact with the tray freezes after the surface freezes and the center of the ice cube is typically the last part to freeze.

Water expands in the transition from liquid to solid. During the freezing and expansion of the water in the center of the ice cube, the walls of the tray act to stop expansion of the ice cube in the direction perpendicular to the compartment walls. Thus the only direction for expansion is perpendicular to the top surface of the ice adjacent the air of the freezer. Thus, a bulge is normally formed in the center of the top surface of the ice cube. This is caused by several factors as mentioned above. Also, because the sides of the cavity usually cool faster after a surface layer of ice is formed, ice will form adjacent the tray walls before forming in the center of the cube. Thus, the center of the ice cube will be the last part to freeze, and this is one of the causes of the bulging effect.

Additionally, once the top surface of the water in the ice forming compartments of the ice tray freezes, gasses are trapped below the solid surface of the ice. These trapped gasses can lead to cracking of the ice in the compartment or to cloudiness of the ice.

After freezing, an ejector arm rotates so that a separate finger or ejector member extends into each compartment to urge the ice formed therein to be ejected. After ejecting the ice, the ejector arm in typical ice makers returns to a position wherein each of the fingers is disposed completely outside of the compartment during the next filling, cooling and freezing cycles.

Consumers often equate cloudy ice with impurities or old ice. Thus, it would be desirable to produce clear ice. It would also be desirable to produce ice without a bulge on the top surface. Such desired results are facilitated by reducing the temperature variation in water in an ice forming compartment of an ice tray during the freezing process. Stirring ice during cooling and prior to freezing facilitates the production of clearer ice while reducing the bulge on the top surface.

According to one aspect of the disclosure, a method of making ice comprises an advancing water step, a reducing step, a stirring step, a moving step and an advancing the ejector member step. The advancing water step includes advancing water into at least one ice forming compartment of an ice tray. The reducing step includes reducing the temperature of the water within the at least one ice forming compartment. The stirring step includes stirring the water within the at least one ice forming compartment with an ejector member during the reducing step. The moving step includes moving the ejector member to a stop position after the stirring step at which the ejector member is spaced apart from the water located in the at least one ice forming compartment. The advancing step includes advancing the ejector member into contact with ice formed in the at least one ice forming compartment after the moving step so that the ice is urged out of the at least one ice forming compartment.

According to another aspect of the disclosure, an icemaker assembly, comprises an ice tray and an ice ejector. The ice tray has at least one ice forming compartment. The ice ejector has at least one ejector member. The ice ejector is operable to (i) stir water located within the at least one ice forming compartment with the at least one ejector member during a first mode, and (ii) urge ice out of the at least one ice forming compartment with the at least one ejector member during a second mode.

According to yet another aspect of the disclosure, a method of making ice comprises an operating an ice ejector of an icemaker in a first mode of operation step and an operating an ice ejector of an icemaker in a second mode of operation step. In the operating an ice ejector of an ice maker in a first mode of operation step, a plurality of ejector members of the ice ejector are respectively advanced through water located within a plurality of compartments of an ice tray of the ice maker during cooling of the water in the ice tray. In the operating the ice ejector in a second mode of operation step, the plurality of ejector members are respectively advanced into contact with ice formed within the plurality of ice forming compartments so that the ice is urged out of the plurality of ice forming compartments.

Additional features and advantages of the present invention will become apparent to those skilled in the art upon consideration of the following detailed description of preferred embodiments exemplifying the best mode of carrying out the invention as presently perceived.

BRIEF DESCRIPTION OF THE DRAWINGS

The illustrative devices will be described hereinafter with reference to the attached drawings which are given as non-limiting examples only, in which.

Corresponding reference characters indicate corresponding parts throughout the several views. Like reference characters tend to indicate like parts throughout the several views.

DETAILED DESCRIPTION

Figure 1:
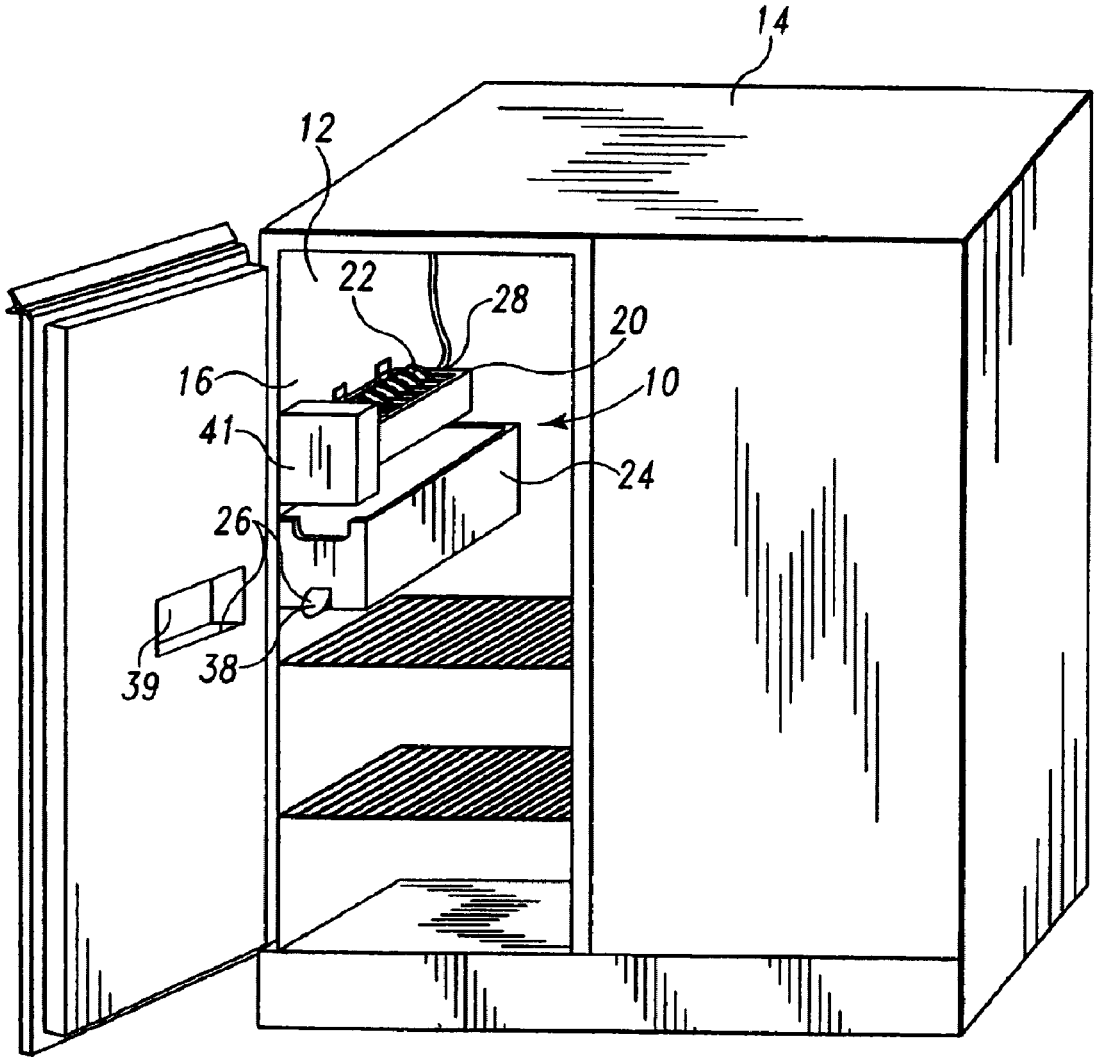
FIG. 1 is a perspective view of an ice maker mounted to the inside of a freezer compartment of a household side-by-side refrigerator/freezer showing an ice maker assembly including an ice tray, an ejector arm and a control box wherein a motor is mounted, a water inlet, and an ice bin.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

The disclosed icemaker assembly 10 and method 1910 facilitate the formation of clearer ice cubes which do not exhibit a prominent bulge on the top surface by stirring water in the compartments 66 of an ice tray 20 while it is being cooled toward freezing. A stirrer 51 is inserted into each compartment 66 following filling and prior to freezing to disturb or stir the water in the compartment 66. The stirrer 51 is removed from each compartment 66 prior to freezing. After filling and prior to freezing, the stirrer 51 is manipulated to stir the water in each compartment 66.

The illustrated embodiment of the ice maker assembly 10 uses the ejector arm 44, which is traditionally used to remove the ice cubes from the compartments 66 when it is frozen as the stirrer 51. The stirrer 51 may be the entire ejector members 52, portions adjacent the front face 118 and/or rear face 120 of the ejector members 52 of the ejector arm 44, or may be formed as a separate set of fingers attached to the ejector arm 44. The ejector members 52 of the ejector arm 44 may be disposed partially or completely in the compartments 66 during the stirring process and removed prior to freezing to facilitate the formation of clear ice cubes that do not include a prominent bulge on the top surface.

In operation, the water is allowed to fill the compartments 66. The ejector members 52, acting as stirrers 51, are introduced into the space 104 where the water is cooling, disturbing some volume of water so that the water is stirred to avoid the formation of a temperature gradient in the water. The ejector members 52 are then utilized as stirrers 51 to stir the water in each compartment 66 as it cools toward the freezing point. Prior to ice formation, at least on the surface of the water, the ejector members 52, acting as the stirrers 51, are completely removed from the ice forming space 104 of each compartment 66.

As shown, for example, in FIG. 1, an ice maker assembly 10 is incorporated in a freezer compartment 12 of a household side-by-side refrigerator/freezer 14. The illustrated refrigerator/freezer 14 includes a through-the-door ice and water dispenser 26. To facilitate through the door delivery of ice, the illustrated ice maker assembly 10 includes an ice tray 20, an ice ejector 22, an ice bin 24, an ice dispenser 26, a water inlet 28, and a controller 30. In the illustrated ice maker assembly 10, the water inlet 28 is in fluid communication with ice tray 20 so that water is added to ice tray 20.

Water received in tray 20 freezes and is removed from tray 20 by ejector 22. Ice ejected from tray 20 is received in bin 24 where it is stored awaiting use. The bin 24 is formed to include a dispenser 26 from which ice is dispensed to the user. In the illustrated embodiment of ice maker assembly 10, dispenser 26 is a through-the-door ice dispenser.

Thus, bin 24 is configured to include a drive system 36 of the dispenser 26 for driving ice from the bottom of the bin 24 to a dispenser opening 38 communicating with a chute 39 communicating with the through-the-door ice outlet.

The household water supply is coupled to the water inlet 28. Water inlet 28 may be controllably opened and shut by an electrically controlled valve such as a solenoid operated valve responsive to a signal received from the controller 30. After harvesting previously formed ice cubes 130, water is permitted to flow into the ice tray 20 to fill each individual ice forming compartment or cavity 66. The illustrated ice tray 20 is formed to include a plurality of compartments 66 extending laterally across the ice tray 20. Each compartment 66 is separated from at least one adjacent compartment 66 by a transverse partition or divider wall 80.

Figure 2:
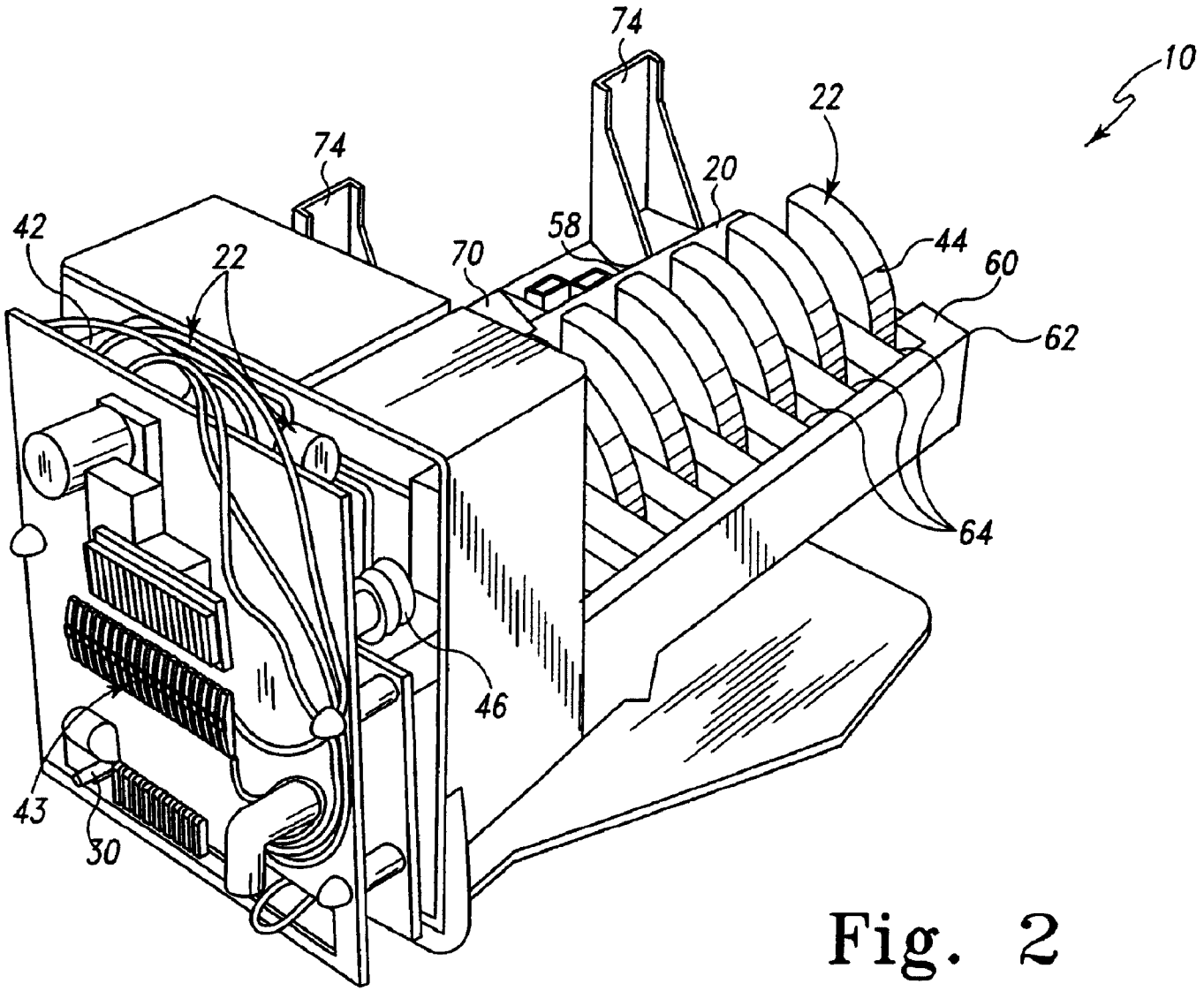
FIG. 2 is a perspective view of the ice maker assembly of FIG. 1 removed from the freezer compartment showing a cover removed from the control box to disclose a controller implemented in part on a PCB and a motor for rotating the ejector arm, the displacement fingers of which are shown partially inserted into compartments of the ice tray.
Figure 3:
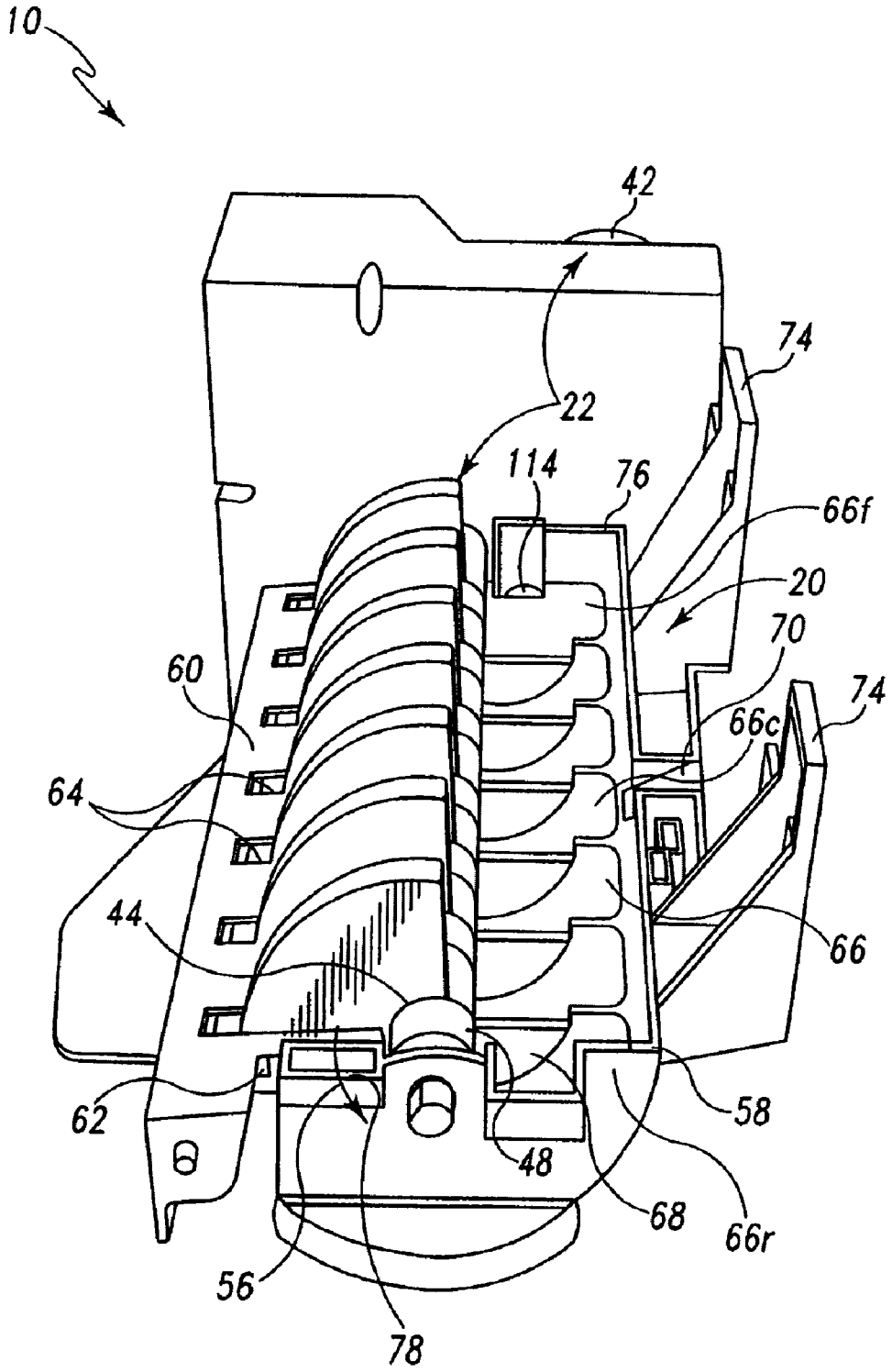
FIG. 3 a perspective view of the ice maker assembly of FIG. 2 from a different perspective showing the ejector arm and ice tray.
Figure 4:
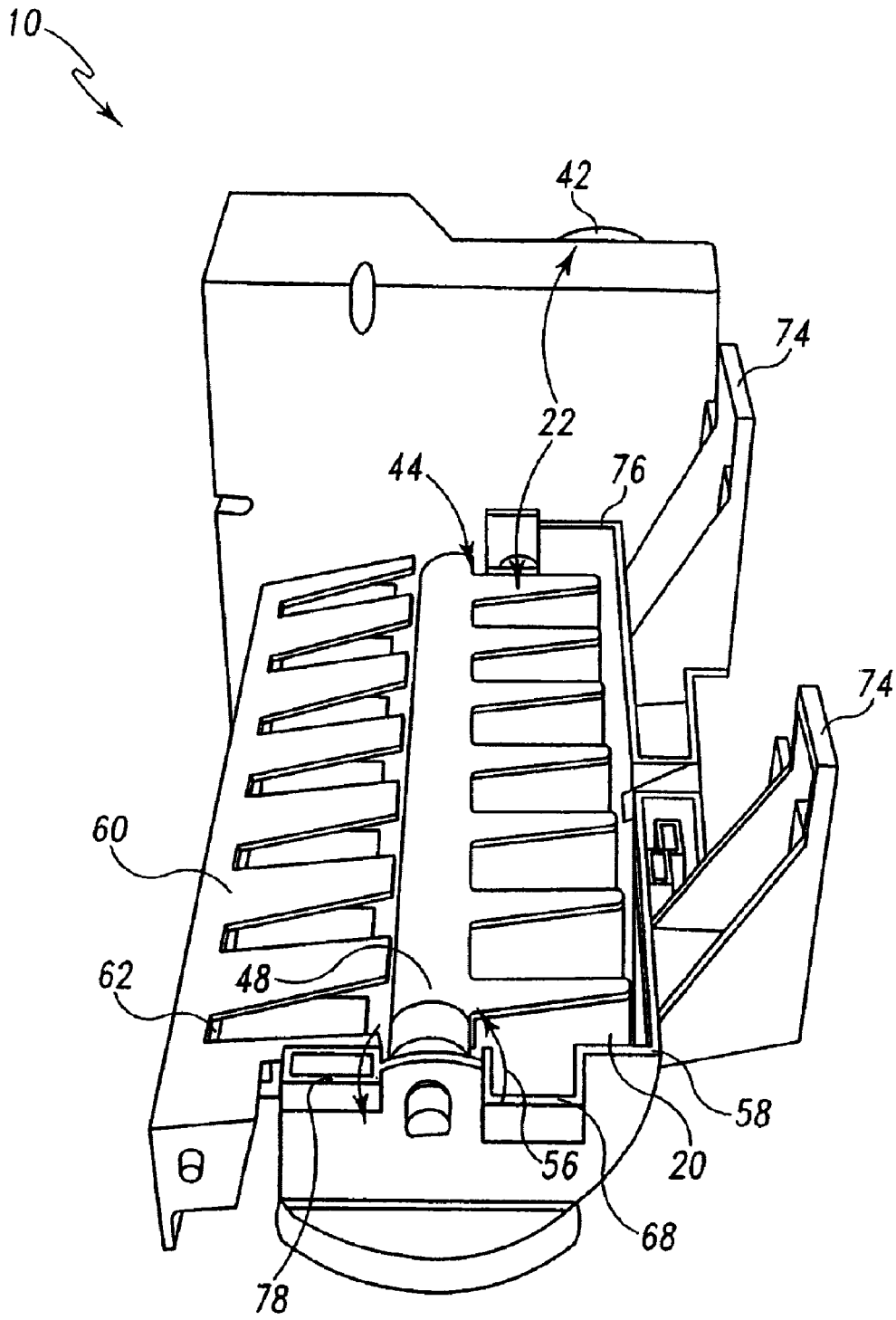
FIG. 4 is a perspective view of the ice tray and ejector arm of the ice maker in a first position wherein ejector members mounted to the shaft of the ejector arm are disposed within the ice forming compartments of the ice tray.

Referring now to FIGS. 2–8, the ice maker assembly 10 is shown removed from the freezer compartment 12 and in various states of disassembly. In FIG. 2, a cover 41 is removed from the ice maker assembly 10 to expose a circuit board 43 containing the controller 30. The ice ejector 22 includes a motor 42 having an output shaft, the ejector arm 44 and a drive train 46 coupling the output shaft of the motor 42 to the ejector arm 44.

Figure 5:
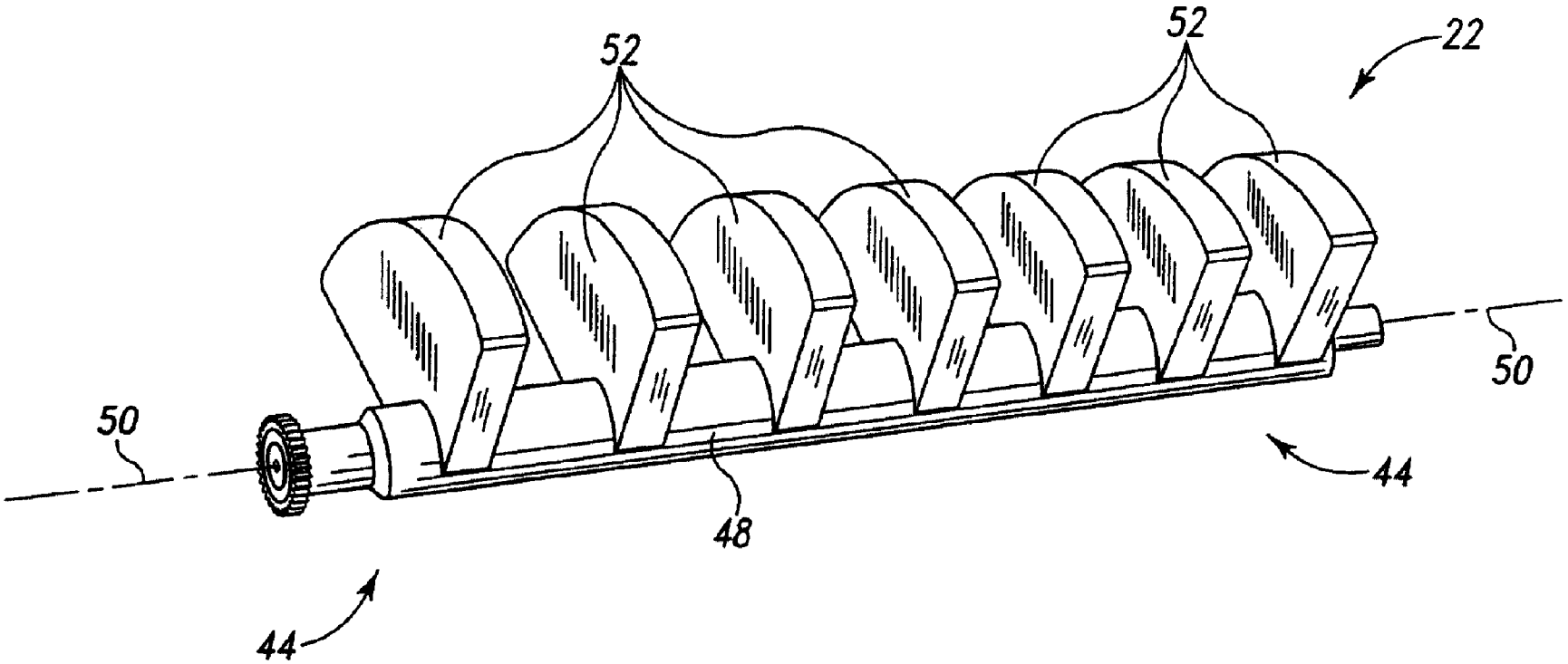
FIG. 5 is a perspective view of the ejector arm of the ice maker assembly of FIG. 2 showing seven ejector members mounted to a shaft configured to be rotated by the motor.
Figure 6:
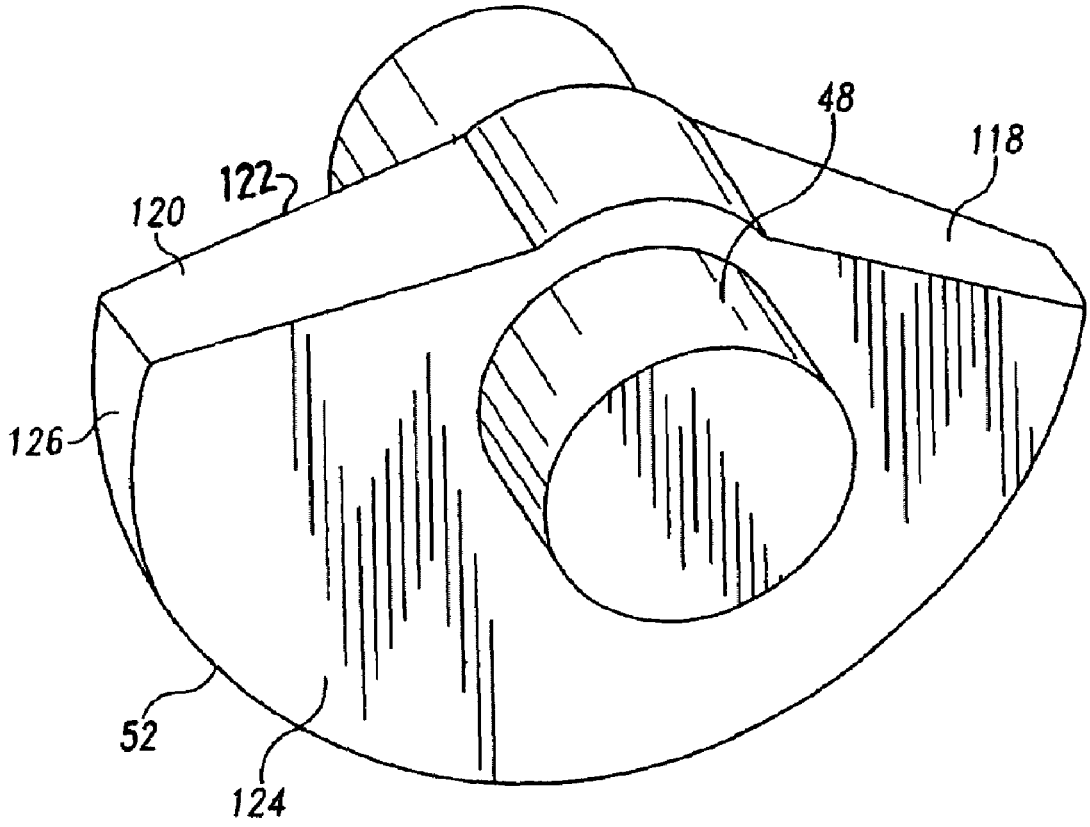
FIG. 6 is a perspective view of a single ejector member of the ejector arm of FIG. 5.

As shown, for example, in FIGS. 5 and 6, ejector arm 44 includes a shaft 48 formed concentrically about a longitudinal axis 50 and a plurality of ejector members 52 connected to and extending radially beyond the shaft 48. In the illustrated embodiment, the ejector members 52 are crescent-shaped fins and are configured to extend from the shaft 48 into the ice tray 20 when the shaft 48 is rotated.

In the illustrated embodiment, the entire ejector arm 44 is molded as a monolithic component including the shaft 48 and the plurality of ejector members 52. However, it is within the scope of the disclosure for the shaft 48 and each of the plurality of ejector members 52 to be formed as separate articles and for the plurality of ejector members 52 to be secured to the shaft 48 for rotation thereby.

As shown, for example, in FIG. 6, each ejector member 52 includes a front face 118 and a rear face 120. Each ejector member 52 also includes a first side wall 122, a second side wall 124 and an outer wall 126 each extending between the front face 118 and the rear face 120. Outer wall 126 is illustratively configured as the sector of a cylinder formed concentrically about the axis 50 of the shaft 48 and extending between front face 118 and rear face 120.

In the illustrated embodiment, front face 118 and rear face 120 are each planar and are angularly displaced from each other by an angle 128. In the illustrated embodiment, the angle between front face 118 and rear face 120 is approximately one hundred ninety-five degrees. Those skilled in the art will recognize that angle 128 is not critical and can assume other values.

Outer wall 126 has a radius 129. Radius 129 is sufficient for a portion of outer wall 126, when ejector arm 44 is properly oriented and mounted to rotate about rotation axis 91, to extend into the ice forming space 104 of a compartment 66 and be positioned vertically below the surface over which water overflows the compartment 66, e.g. the top wall 98 of the overflow channel 90 of ice tray 20. Illustratively, radius 129 is sufficient to place outer wall 126 over half way between the shaft 48 and the bottom wall 82 of the compartment 66 without engaging the bottom wall 82 of the compartment, as shown, for example, in FIGS. 9–16 when the ejector arm 44 is mounted for rotation about rotation axis 91. When ejector members 52 are utilized as stirrers 51, radius 129 should be large enough to ensure that each ejector member 52 can extend to engage the surface of the water in the compartment 66 when the ejector arm 44 is properly mounted and oriented.

The side walls 122, 124 extend radially outwardly from the shaft 48 to the outer wall 126. In the illustrated embodiment, walls 122, 124 are each sectors of a convex cone that tapers slightly inwardly, as shown, for example, in FIG. 6, as they extend radially from the shaft 48 to the outer wall 126. Thus, in the illustrated embodiment, the ejector member 52 is thinner near the outer wall 126 than near the shaft 48 as measured perpendicular to the rotation axis 91. As shown, for example, in FIGS. 2–3, the slots 64 in ice guiding cover 60 are configured to facilitate the passage of the ejector members 52 therethrough without contacting the cover 60 during rotation of the ejector arm 44 about the rotation axis 91. Thus, ejector members 52 have a width, measured perpendicular to the rotation axis, that in the illustrated embodiment narrows as the side walls 122, 124 extend radially from the shaft 48 to the outer wall 126.

It is within the scope of the disclosure for side walls 122, 124 to be planar and oriented to be perpendicular to the rotation axis 91, so that the ejector members 52 have a uniform width, or to be sectors of a concave cone so as to taper outwardly, so that the ejector members 52 have an increasing width, as the side walls 122, 124 extend from the shaft 48 to the outer wall 126. The width of each ejector members 52 should be less than the narrowest width of the compartment 66 through which it must pass during rotation of the ejector arm 44 about the rotation axis 91.

Those skilled in the art will recognize that ejector members 52 may assume other configurations than those described above and still serve the purpose of acting as an ejector member 52 and a stirrer 51. Also, even though the illustrated embodiment of ice maker assembly 10 shows the ejector members 52 of the ejector arm 44 being configured and utilized to act as both ejector members 52 for ejecting ice cubes, displacement members 53 for displacing water during the filling process, and stirrers 51 for stirring the water while cooling, it is within the scope of the disclosure for water to be displaced during the filling process in other ways and by other devices and for the water to be stirred in other ways and by other devices. For instance, it is envisioned that the ejector arm 44 may be configured to include distinct ejector members 52, displacement members 53 and stirrers 51 each extending radially from the shaft 48 but angularly displaced from one another. It is also within the scope of the disclosure for a mechanism to be provided for disposing stirrers into the ice forming space 104 during the cooling process that are not rotated by the shaft 48 of the ejector arm 44.

It is within the scope of the disclosure for ejector members 52 to be fingers, shafts or other structures extending radially beyond the outer walls of shaft 48. Rotation of the output shaft of the motor 42 is transferred through the drive train 46 to induce rotation of the ejector arm 44 about its longitudinal axis 50.

Figure 8:
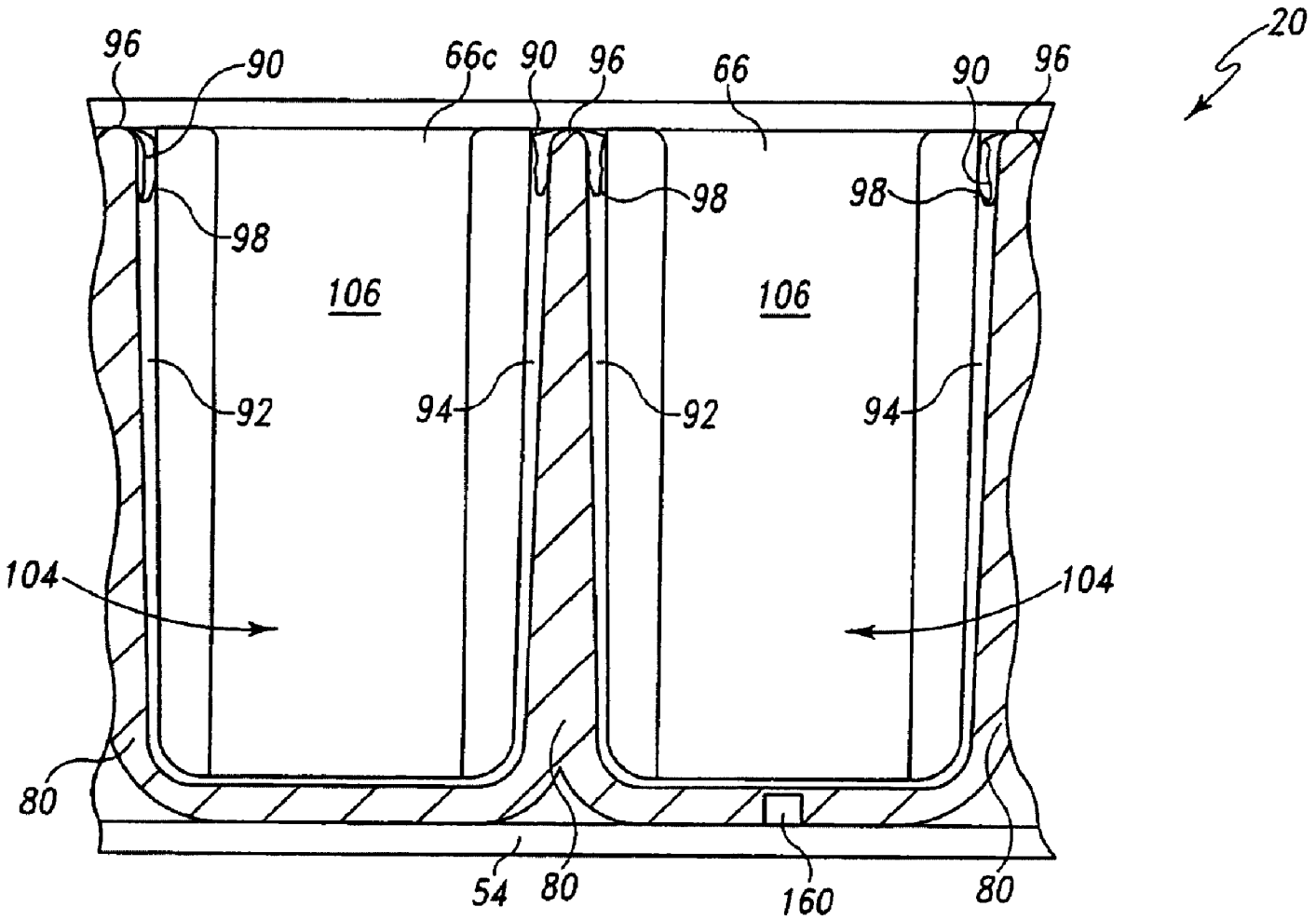
FIG. 8 is a sectional view of the ice tray taken along line 8—8 of FIG. 7 which also shows a heater disposed below the ice tray and a temperature sensor.

Controller 30 includes a microcontroller, sensors and a timer to control the motor 42 and ice tray heater 54 (FIG. 8). In the illustrated embodiment, motor 42 may be a stepper motor such as a Series LSD42 direct drive, 4 phase bifilar, stepping motor available from Hurst Manufacturing, a part of Emerson Motor Company, St. Louis, Mo. When such a motor is utilized, the controller 30 includes a stepper motor controller configured to control the rotational movement of the motor 42 by energizing the coils to start, stop and reverse the direction of the motor 42, as more particularly described hereafter in the description of FIGS. 9–16. The disclosed stepper motor is supplied with four wires (white, blue, red and black) for energizing the coils of the motor 42. The controller 30 induces clockwise rotation by energizing the white and blue wires, white and red wires, black and red wires and black and blue wires in a cyclical fashion. The controller induces counter-clockwise rotation by energizing the black and blue wires, black and red wires, white and red wires and white and blue wires in a cyclical fashion. Stepper motor controller may be implemented on a separate integrated circuit, such as a Model 220001 stepper motor controller available from Hurst Manufacturing or the like, in the microprocessor or microcontroller or through separate logic circuitry within the scope of the disclosure.

In another embodiment, motor 42 is a unidirectional synchronous motor such as a permanent magnet synchronous speed gear motor available from Mallory Controls, a Division of Emerson, Indianapolis, Ind. Such a motor has a constant rotor speed proportional to the frequency of the AC power supply. When such a motor is utilized, controller 30 rotates the ejector to repeatedly submerge the entire ejector member 52 in the compartment 66 to act as stirrers 51 during a cooling cycle. In one current embodiment of icemaker assembly 10, a unidirectional motor 42 is stopped during filling to dispose the entire ejector member 52 in the cavity, as shown, for example, in FIG. 9, to displace water so that a minimum sized ice cube can be formed. Such a unidirectional motor can be stopped during filling to dispose a portion adjacent the front face of the ejector member 52 in the cavity, as shown, for example, in FIG. 10 or 11, to form a larger ice cube. Alternatively, such a unidirectional motor can be stopped during filling to dispose a portion adjacent the rear face of the ejector member 52 in the cavity, as shown, for example, in FIG. 16, to form a larger ice cube.

In the illustrated embodiment in which the ejector members 52 are used as both displacement members 53 and stirrers 51, the controller 30 controls the motor 42 so that rotation of the ejector arm 44 is stopped with the ejector members 52 disposed completely outside the ice forming space 104 of each compartment 66 for a period of time to permit water to freeze in the ice tray 20. Once the water is frozen in the ice tray 20, controller 30 enables motor 42 to drive the ejector arm 44 in the direction of arrow 56 in FIGS. 3, 4, 12, 14, 15 causing ice in the tray 20 to be forced out of the ejection side 58 of the tray 20. In the illustrated embodiment, ejection side 58 of the tray 20 is the side of the tray 20 adjacent the side wall 16 of the freezer compartment 12 to which the ice maker assembly 10 is mounted.

An ice guiding cover 60 extends inwardly from the outside 62 of the tray 20 and is configured to include slots 64 formed therein to permit the ejection members 52 of the ejector arm 44 to extend through slots 64 in the cover 60 into the ice tray 20. Ice cubes ejected from ejection side 58 of the tray 20 fall onto the fingers between the slots 64 in the cover 60 and slide off of the outer edge of the cover 60 into the ice bin 24.

Figure 7:
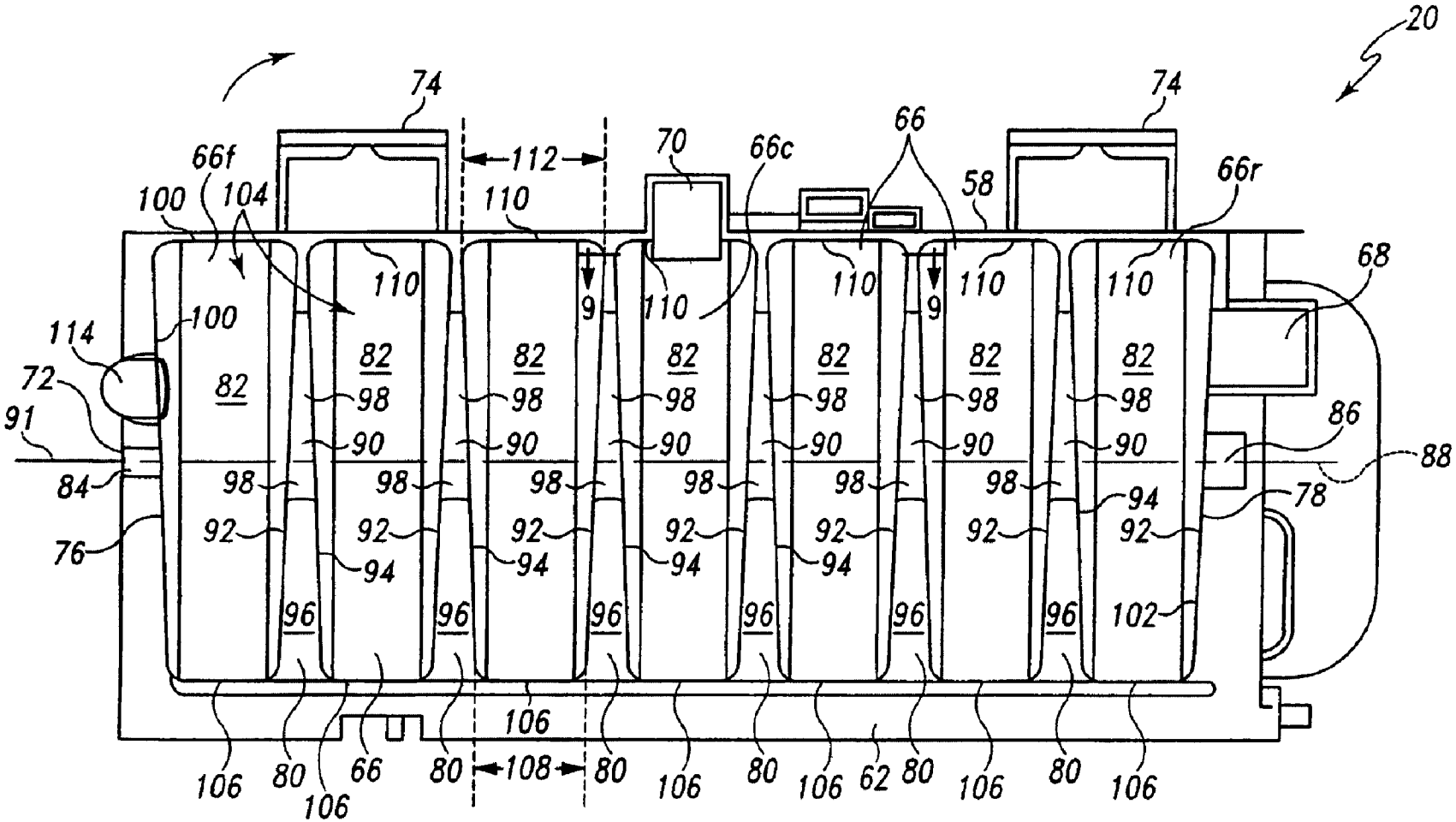
FIG. 7 is a plan view of the ice tray of FIG. 4 showing the configuration of the divider walls between adjacent crescent-shaped compartments.

As shown, for example, in FIG. 7, ice tray 20 is formed to include seven tapered crescent-shaped compartments 66, an end water inlet ramp 68, a side water inlet ramp 70, ejector arm mounting features 72, and mounting brackets 74. Tray 20 includes a first end wall 76, a second end wall 78, a plurality of partitions or divider walls 80 and a plurality of floor walls 82 that cooperate to form the ice forming compartments 66. In the illustrated embodiment, as shown in FIG. 1, the end water inlet ramp 68 is formed in the second end wall 78 to be positioned below the water inlet 28 to facilitate filling the seven compartments 66 using the overflow method. The side water inlet ramp 70 is provided for those refrigerator/freezers 14 that position the water inlet along the mounting wall 16 of the freezer compartment 12. Illustratively, each ice forming compartment 66 is a tapered crescent-shape.

The ejector mounting arm features 72 include a shaft-receiving semi-cylindrical bearing surface 84 formed in the first end wall 76, a shaft-receiving semi-cylindrical bearing surface 86 formed in the second end wall 78, a shaft-receiving aperture 88 formed through the second end wall 78, and portions of each of a plurality of overflow channels 90 formed in each divider wall 80. The shaft-receiving semi-cylindrical bearing surfaces 84, 86 and the shaft-receiving aperture 88 are formed concentrically about the rotation axis 91 of the shaft 48 of the ejector arm 44. The shaft-receiving semi-cylindrical bearing surfaces 84, 86, the shaft-receiving aperture 88 and the portions of the overflow channels 90 are sized to receive the shaft 48 of the ejector arm 44 for free rotation therein. The shaft-receiving semi-cylindrical bearing surfaces 84, 86, the shaft-receiving aperture 88 and the portions of the overflow channels 90 are positioned to permit the longitudinal axis 50 of the shaft 48 of the ejector arm 44 to coincide with the rotation axis 91 when the ejector arm 44 is received in the tray 20 and rotated by the motor 42 and drive train 46.

In the illustrated embodiment, mounting brackets 74 extend from the ejection side 58 of the ice tray 20 to facilitate mounting the tray 20 to the mounting side wall 16 of the freezer compartment 12. It is within the scope of the disclosure for other mounting features to be present on the tray 20 and for those mounting features to facilitate mounting of the tray 20 to other structures within the freezer compartment 12.

As mentioned above, each partition or divider wall 80 extends laterally, relative to longitudinal axis 50, across the ice tray 20. In the illustrated embodiment, each divider wall 80 includes a forwardly facing lateral side surface 92, a rearwardly facing lateral side surface 94 and a top surface 96. The forwardly facing lateral side surface 92, rearwardly facing lateral side surface 94 and top surface 96 are formed to include an overflow channel 90. Each overflow channel 90 includes a top wall 98 positioned below the top surface 96 of the divider wall 80. The top wall 98 of the overflow channel 90 is positioned near the desired maximum fill level of each compartment 66. The first end wall 76 includes a rearwardly facing lateral side surface 100. The second end wall 78 includes a forwardly facing lateral side surface 102.

In the illustrated embodiment, water from the water inlet 28 flows down the end water inlet ramp 68 into the rear ice forming compartment **66*r*. The water enters and fills the rear ice forming compartment 66*r* until the level reaches the level of the top wall 98 of the overflow channel 90 and then overflows into the compartment 66 adjacent the rear compartment 66*r*. After water fills each compartment 66 it overflows through the overflow channel 90 into the adjacent compartment 66. When the water in all of the compartments 66 has reached a desired level, water flow stops. This method of filling an ice tray 20** is often referred to as the overflow method.

The overflow method can also be used to fill all of the compartments 66 of the ice tray 20 when water first flows into the center compartment **66*c*, into which the side water inlet ramp 70 flows, when the water inlet is mounted to the mounting side wall 16 of the freezer compartment 12. When water first enters the tray 20 through the side water inlet ramp 70, the water overflows in both directions to fill each compartment 66 of the tray 20**.

As shown, for example, in FIGS. 7–16, the compartments 66 of ice tray 20 are configured to include a space 104 in which a tapered crescent-shaped ice cube 130 is formed. In the illustrated embodiment first end wall 76 includes a planar lateral side surface 100 and second end wall 78 includes a planar lateral side surface 102. Each partition member or divider wall 80 includes a top surface 96 and two downwardly extending oppositely facing lateral side surfaces 92, 94.

The forwardly facing planar lateral side surface 102 of the second end wall 78, the rearwardly facing planar lateral side surface 94 of the divider wall 80 adjacent the second end wall 78 and the arcuate bottom surface or floor wall 82 cooperate to define a space 104 in the rear compartment **66*r* in which ice is formed. Similarly, the rearwardly facing planar lateral side surface 100 of the first end wall 76, the forwardly facing planar lateral side surface 92 of the divider wall 80 adjacent the first end wall 76 and the arcuate bottom surface 82 cooperate to define a space 104 in the front compartment 66*f* in which ice is formed. The spaces 104 in which ice is formed in the intermediate compartments 66 are defined by the rearwardly facing planar lateral side surface 94 of a divider wall 80, the forwardly facing planar lateral side surface 92 of the adjacent divider wall 80 to the rear of the first divider wall 80 and the arcuate bottom surface 82. Thus the ice forming space 104 in each compartment 66 includes a first planar lateral side surface 100 or 94, a second planar lateral side surface 102 or 92, and an arcuate bottom surface 82 interposed between the first lateral side surface 100 or 94 and the second lateral side surface 102 or 92**.

As show, for example, in FIGS. 7, 8, each compartment 66 is substantially identical. In each compartment 66, one planar lateral side surface 100, 94, from an end wall 76 or a divider wall 80, respectively, is positioned relative to a second planar lateral side surface 92, 102, from an adjacent divider wall 80 or end wall 78, respectively, so that the first planar lateral side surface 100, 94 is spaced apart from the second planar lateral side surface 92, 102 at a downstream end 106 by a distance D1 108 relative to an ejection path of movement. As mentioned previously, the ejection path of movement in the illustrated ice maker assembly 10 is laterally across the ice tray 20 from the outside 62 of the ice tray 20 to the ejection side 58 of the ice tray 20. Thus, as used herein, the downstream end 106 is adjacent the outside 62 of the tray 20. Therefore, adjacent the outside 62 of the tray, the first planar lateral side wall 100, 94 of each compartment 66 is spaced apart from the second planar lateral side surface 92, 102 by the distance D1 108.

In each compartment 66, the first planar lateral side surface 100, 94 is spaced apart from the second planar lateral side surface 92, 102 at an upstream end 10 of the compartment 66 by a distance D2 112 relative to said ejection path of movement. In the illustrated embodiment, the upstream end 110 of the compartment 66 is the end of the compartment 66 adjacent the ejection side 58 of the tray 20. As shown, for example, in FIG. 7, the distance D2 112 is greater than the distance D1 108.

In the illustrated embodiment, each lateral side surface 92, 94, 100, 102 is planar, except for a bottom portion that smoothly curves into the bottom surface 82 to facilitate formation of the ice tray 20 using a molding process. As in prior art ice trays, the width of the compartment 66 may be narrower near the bottom and wider near the top, as shown, for example, in FIG. 7, to facilitate formation of the ice tray 20 using a molding process. The disclosed ice tray forms tapered crescent-shaped ice cubes 130 which facilitate harvesting of the ice cubes by reducing heating of the tray prior to ejection. The tapered crescent-shaped ice cubes 130 and compartments 66 reduce torques exerted on the motor 42, ejector arm 44 and drive train 46 during ejection and reduce ice chips which may be formed by forcing wider sections of an ice cube through narrower sections of a compartment during ejection. Such an ice tray 20 is more particularly described in U.S. patent application Ser. No. 10/895,570, entitled Method and Device for Producing Ice Having a Harvest-facilitating Shape, which is assigned to the same assignee as the present invention, and which is filed concurrently herewith, the disclosure of which is hereby incorporated by reference in its entirety.

An ice cube 130 formed in a space 104 in an illustrated compartment 66 of the ice tray 20 has an external shape conforming on three surfaces to the lateral side surfaces 92, 102 and 100, 94, respectively, and bottom surface 82 of the compartment 66. On the top surface 132, the ice cube 130 is substantially flat.

The ice cube 130 includes a first lateral side wall and oppositely facing second lateral side wall and an arcuate shaped bottom wall 138 extending between the first and second lateral side walls. The ice cube 130 has a narrow end 140 having a width substantially equal to the distance D1 108 and a wide end 144 having a width substantially equal to the distance D2 112.

Except where they merge with bottom wall 138, side walls of the ice cube 130 are substantially planar as a result of the ice conforming to the shape of the lateral side surfaces 100, 94 and 92, 102 of the compartment 66. The distance between lateral side walls at any level of the cube 130 increases slightly from bottom to top as a result of conforming to the lateral side surfaces 100, 94 and 92, 102 of the ice forming compartment 66 which are configured to facilitate formation of the ice tray 20 using a molding process. The distance between lateral side walls of the ice cube 130 increases asymptotically from the narrow end 140 to the wide end 144.

Although described and illustrated as being planar, it is within the scope of the disclosure for lateral side surfaces 100, 94 and 92, 102 of the compartment 66 to have other configurations such as being arcuate shaped. Preferably, the distance between oppositely facing lateral side surfaces 100, 94 and 92, 102 of a compartment 66 increases asymptotically in relation to the ejection path of movement.

While described and illustrated as having the same configuration, it is within the scope of the disclosure for each compartment 66 to have differing configurations. For example, it is within the scope of the disclosure for one compartment 66 to include a planar lateral side surface, an oppositely facing arcuate lateral side surface and an arcuate bottom surface while another compartment 66 includes two oppositely facing planar lateral side surfaces and a sloped bottom surface. Various combinations of lateral side surface and bottom surfaces may be used to define a compartment 66. It is also within the scope of the disclosure for a standard ice tray to be utilized to form ice from water that is stirred while cooling toward the freezing point.

In the illustrated embodiment, the distal or rear compartment **66*r* is in fluid communication with the water inlet 28. The distal or rear end wall 102 of the ice tray 20 is formed to include a sluiceway or water inlet ramp 68 that water from the inlet 28 flows down into the distal ice forming compartment 66*r*. The illustrated ice tray 20 is a overflow fill tray wherein each compartment 66 is filled with water to the point of overflowing and the overflow water from one compartment 66 acts to fill the adjacent compartment 66. In the illustrated ice tray 20, the proximal or front compartment 66*f* is the last compartment to be filled. The proximal or front end wall 100 of ice tray 20 is formed to include an overflow or fill depth reservoir 114. Water from the proximal compartment 66*f* flows into the fill depth reservoir 114 after the level of the displaced water in the proximal compartment 66*f* exceeds a desired minimal level. When the ejector members 52 are removed from the compartments, water in the fill depth reservoir 114 drains into the proximal compartment 66*f***.

In order to adjust the water fill level in all of the compartments 66, it is within the scope of the disclosure for all or a portion of the ejector member 52 of the ejector arm 44 to be disposed in the compartments 66 of the ice tray 20 to act as displacement members 53 during filling by positioning the ejector arm 44 as shown, for example, in FIGS. 9, 10, 11 or 16. It is within the scope of the disclosure for the ejector members to be positioned in any of a plurality of non-disclosed partially submerged positions to allow for production of variable sized ice cubes. Those portions of the displacement members 53 will fill some of the volume of the ice forming space 104 in the compartment 66 displacing water in each compartment 66 to induce overflow when less water is in each compartment 66 than would be required to induce overflow if the entire displacement member 53 were removed from the compartment 66. A method for using the ejector members 52 of the ejector arm as displacement members 53 to displace water during the filling process is disclosed in co-pending U.S. patent application, Ser. No. 895,792, entitled Method and Device for Eliminating Connecting Webs between Ice Cubes filed concurrently herewith, the disclosure of which is hereby incorporated herein by this reference. Such application is assigned to the common assignee of the current application. It is also within the scope of the disclosure for a standard ice tray having weirs between the compartments to be utilized to form ice from water that is stirred while cooling toward the freezing point.

As mentioned above, if the water is allowed to simply sit in the ice forming space 104 of a compartment 66 during the freezing process, non-uniformities in temperature, or even a temperature gradient, may develop in the water in each ice forming compartment 66 of the tray 20. It is possible to reduce or eliminate the non-uniformities, or even invert the temperature gradient, in water in the ice forming compartments 66 of an ice tray 20 by stirring the water. Stirring induces the water to attain a substantially isothermal state with no or little temperature variation during the cooling process as the water approaches the freezing point.

It is not practical to stir the water as it freezes. Thus, during the actual freezing process, stirring is stopped. However, it is preferable to stir the water until it is close to freezing. Unless the temperature of the water can be accurately measured, it is difficult to know accurately when to stop stirring. The disclosed ice maker assembly 10 and method of making ice stirs the water prior to freezing and determines when the stirring should stop.

Most ice maker assemblies use a harvest or ejector arm 44 to assist in ejecting the ice cube 130 from the compartments of the tray 20. Often prior to the ejector members 52 of the ejector arm 44 contacting the top surface of the ice 130, a heater 54 is used to increase the temperature of the bottom of the tray 20, causing the tray 20 to expand and possibly inducing the surface of the ice cube 130 adjacent the tray 20 to melt to form a small layer or liquid water. This aids in ejecting the ice. When it is determined that there is sufficient expansion and or melting, the ejector arm 44 is allowed to run, and it forces the ice out of the tray 20, as shown, for example, in FIGS. 14 and 15. After ejection, the ice cubes 130 typically fall into the storage bin 24. Alternatively, the ejector arm 44 may be activated before the tray expands and/or the surfaces of the ice cube 130 adjacent the walls of the compartment 66 changes into liquid water. In such a scenario, the motor 42 is stalled when it initially contacts the top surfaces 132 of the ice cubes 130 and remains stalled until the friction is sufficiently reduced by the heater 54.

Figure 17:
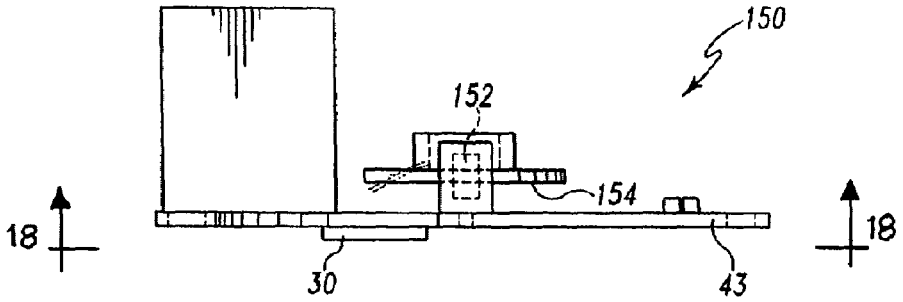
FIG. 17 is an elevation view of portions of the PCB with components removed for clarity showing a transformer, a rotary detection emitter and sensor and a ejector arm encoder face cam of the drive train for detecting the position of the ejector arm.
Figure 18:
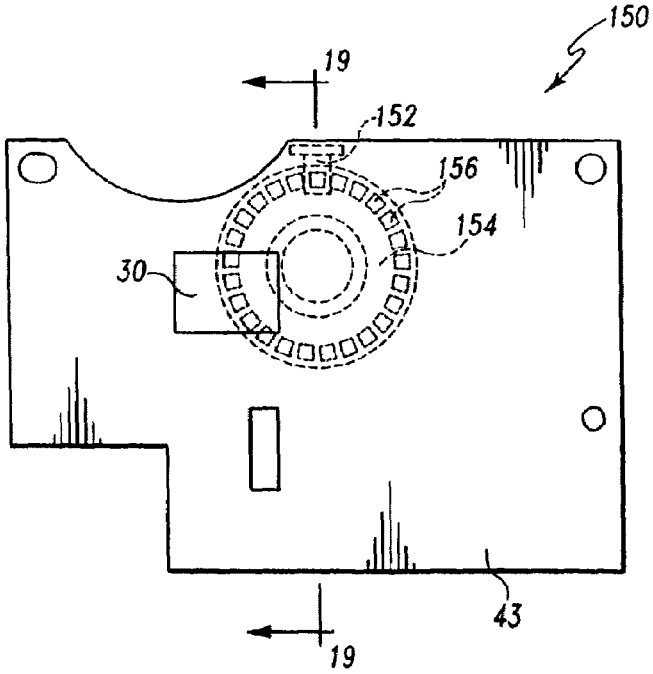
FIG. 18 is a plan view taken along line 18—18 of FIG. 17.
Figure 19:
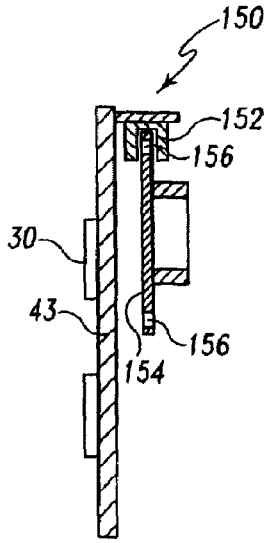
FIG. 19 is a sectional view taken along line 19—19 of the PCB, a rotary detection emitter and sensor, ejector arm encoder face cam and indicia of FIG. 18.

As shown, for example, in FIGS. 17–19, the icemaker assembly 10 includes an ejector arm position sensor 150 coupled to the controller 30. Illustratively, the position sensor 150 is implemented using a rotary detection emitter and sensor 152 and an ejector arm encoder face cam 154 of the drive train 46. Illustratively, rotary detection emitter and sensor 152 may be an Optek PHOTOLOGIC® slotted optical switch, such as Part Number OPB961N51 available from Optek Technology, Inc., 1215 W. Crosby Road Carrollton, Tex. 75006.

The ejector arm encoder face cam 154 is one component of drive train 46 coupling motor 42 to the ejector arm 44. By sensing the position of the ejector arm encoder face cam 154, the position of the ejection members 52 is established. The ejector arm encoder face cam 154 includes indicia 156 responsive to the rotary detection emitter and sensor 152 for indicating the angular position of the ejector arm 44. In the illustrated embodiment, indicia 156 includes a plurality of holes formed in the ejector arm encoder face cam 154 for permitting signals transmitted by the rotary detection emitter to propagate to the rotary position sensor.

As shown for example, in FIG. 19, the ejector arm encoder face cam 154 and rotary detection emitter and sensor 152 are mounted so that the ejector arm encoder face cam 154 rotates within the slot between the sensor and emitter in the rotary detection emitter and sensor 152. The solid portions of the ejector encoder face cam 154 interfere with the signal emitted by the rotary detection emitter when they are disposed between the emitter and sensor. Those skilled in the art will recognize that other indicia and rotary detection emitter and sensors, including indicia comprising reflective surfaces that reflect emitted signals onto a signal sensor are within the scope of the disclosure. It is within the scope of the disclosure for such reflective indicia to be coded so that the exact position of the ejector arm 44 can be determined during rotation.

Preferably indicia 156 are present to selectively interfere, or not interfere, with the detection signal when the ejector arm 44 is positioned as shown in each of FIGS. 9–16. Alternative methods and components may be used to detect the position of the ejector arm 44 within the scope of the disclosure including Hall sensors, tracking the energized winding of a stepper motor when such is used as the motor 42, strobes and optical sensors and the like.

Figure 21:
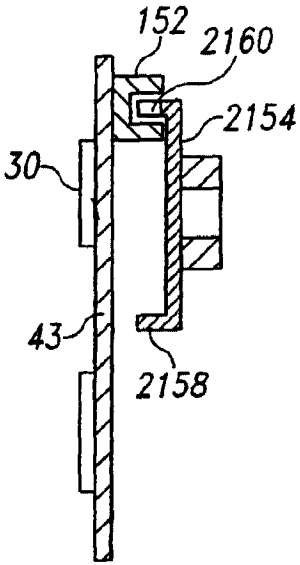
FIG. 21 is a sectional view similar to that shown in FIG. 19 showing the alternative ejector arm encoder face cam of FIG. 20, a PCB and a rotary detection emitter and sensor positioned to sense the indicia.
Figure 20:
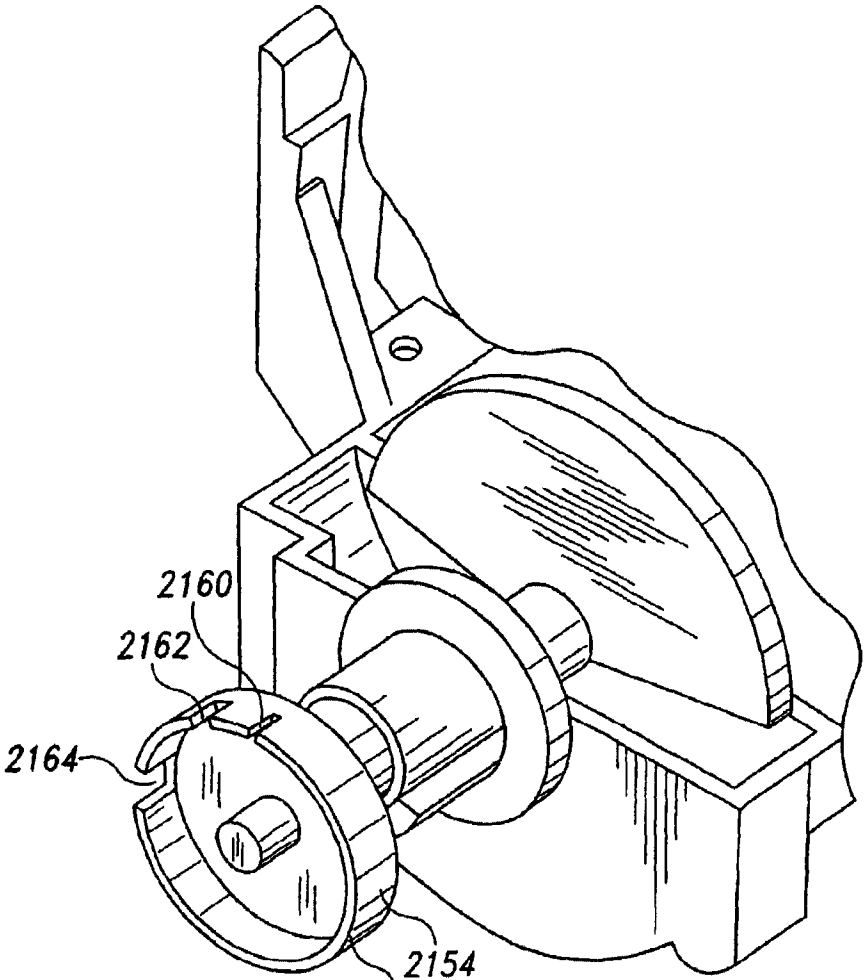
FIG. 20 is a perspective view of a portion of an ice tray, ejector arm and an alternative ejector arm encoder face cam having indicia formed as slots in a cylindrical axially extending wall.

As shown, for example, in FIGS. 20–21, a PCB 43 may include a rotation detector emitter and sensor 152 mounted in an orientation permitting a cylindrical axially extending wall 2158 of an alternative drum-type ejector arm encoder face cam 2154 to pass between its emitter and detector. Slots 2160, 2162, 2164 are formed in the cylindrical axially extending wall 2158 to act as indicia 156. In the illustrated embodiment, indicia 156 include a home position slot 2160, a stall position slot 2162 and a heater disengagement slot 2164. Illustratively, rotation detection emitter and sensor 152 is mounted so that the home slot 2160 is positioned between the emitter and sensor when the ejector arm 44 is positioned to dispose the entire ejector member 52 outside of the ice forming cavities 66, i.e. in a position such as that shown in FIGS. 13, 20–21.

In a current low cost implementation of the invention, a unidirectional motor 42 is utilized to rotate the ejector arm continuously in one direction during cooling so that the ejector member 52 is repeatedly passed through the compartment 66 during cooling. In such an implementation of the invention, it is sufficient to be able to determine when the ejector members 52 are disposed completely outside of the water forming compartments 66 so that they may be stopped in such a location during the final freezing of the ice cubes 130.

Those skilled in the art will recognize that a single home position slot 2160 would be sufficient to provide a calibration point for open loop control of the position of the ejection members 52 based on tracking the windings that are energized in a stepper motor or elapsed time and angular velocity or other open loop control algorithms for other electric motors. It is also within the scope of the disclosure, for a plurality of equal width evenly spaced slots to be disposed around the axially extending wall 2158 of a drum-type ejector arm encoder face cam 2154 to provide feedback regarding the position of the ejector arm 44.

Figure 14:
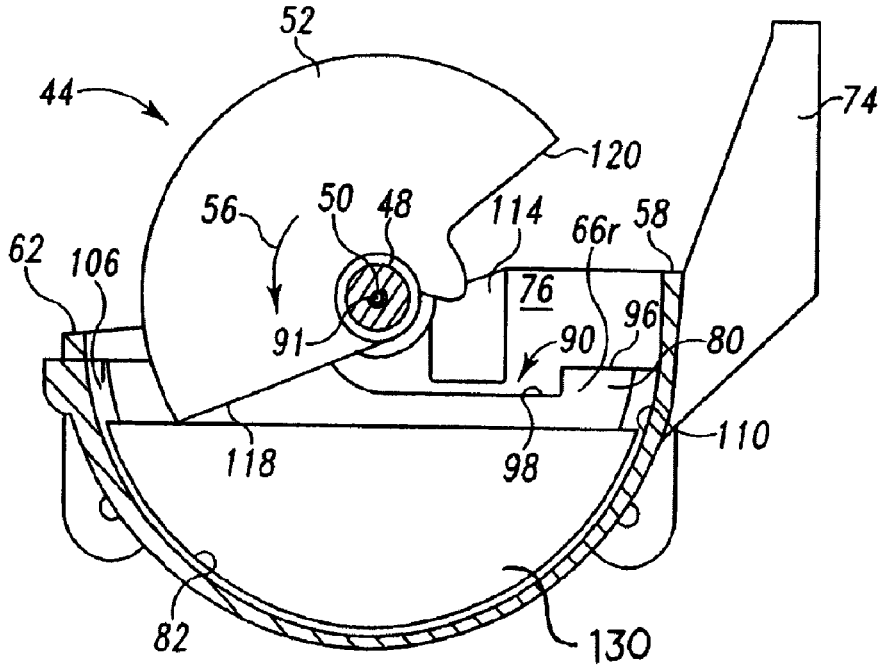
FIG. 14 is a sectional view similar to FIG. 13 after ice has formed in the compartment and the ejector arm has been rotated to bring the front face of the ejector member into contact with the top surface of the ice cube formed in the compartment.
Figure 15:
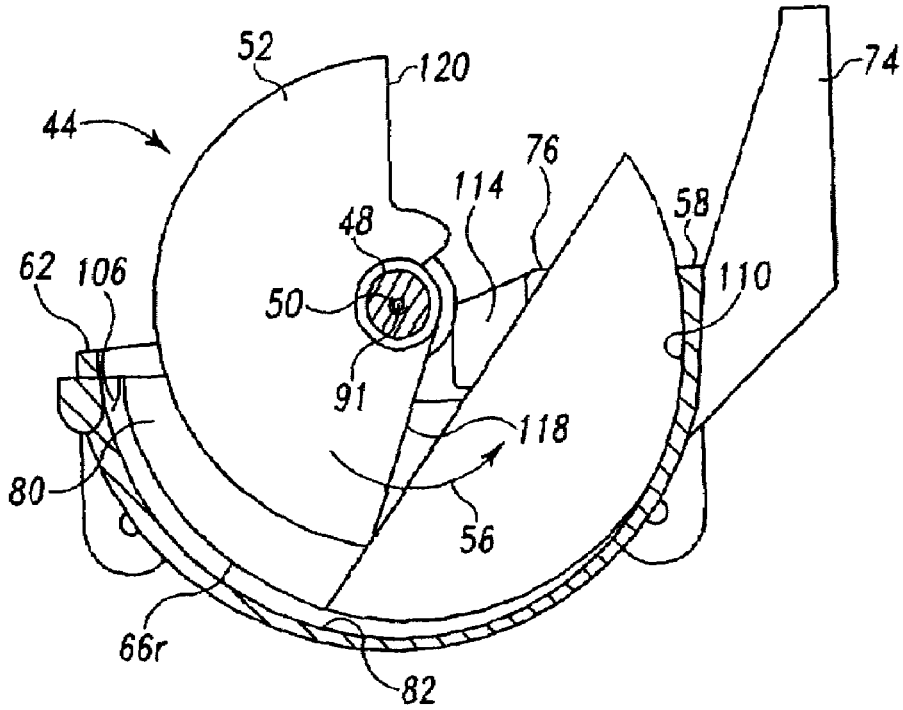
FIG. 15 is a sectional view similar to FIG. 14 after the ejector arm has rotated partially into the ice forming space to urge the ice cube formed in the compartment along an ejection path of motion.
Figure 16:
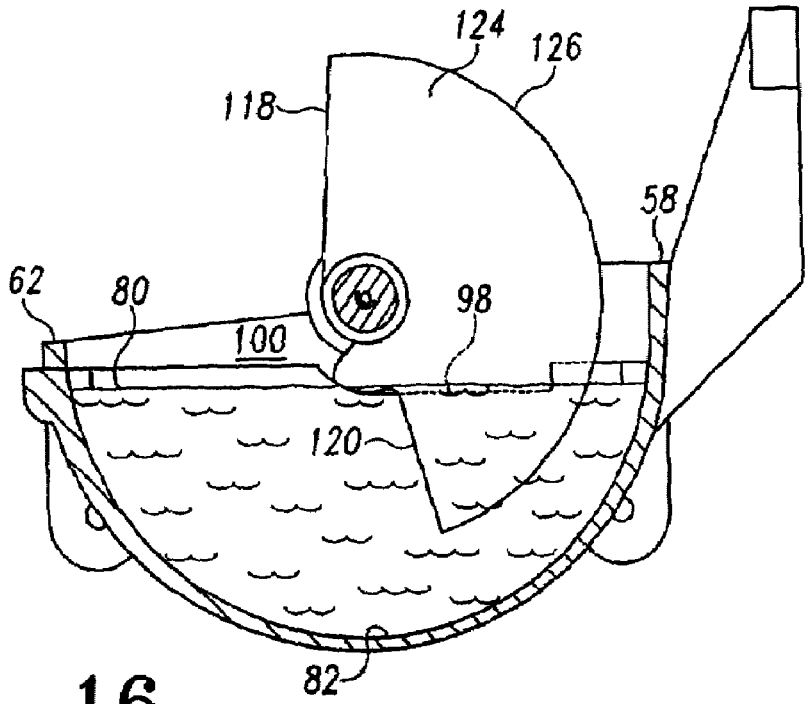
FIG. 16 is a sectional view similar to FIG. 11 showing a rear portion of the ejector member disposed in the ice forming compartment to stir the water in the compartment either as one position assumed during the continual rotation of the ejector member or a position assumed when a reversible motor drive the ejector member to insert and retract the rear face of the ejector member to act as a stirrer during cooling.

As shown, for example, in FIG. 20, the stall slot 2162 is located on the cylindrical axially extending wall 2158 of the ejector arm encoder face cam 2154 so that the slot 2162 is disposed between the emitter and sensor of the rotation detection emitter and sensor 152 when the ejection members 52 are in a position where they are likely to engage ice formed in the ice forming compartments 66, i.e. in a position such as that shown in FIG. 14. Thus, sensor sends a stall condition signal to controller 30 during the period that it is able to detect the signal emitted by the emitter as a result of the stall slot 2162 being disposed between the sensor and emitter of the rotation detection emitter and sensor 152. During an ejection cycle, the stall condition signal indicates that the conditions are ripe for a motor stall. When the ejector members 52 first engage the ice formed in the ice forming compartment, the motor 42 and ejector arm 44 often stall. Thus, when the controller 30 receives a stall condition signal during an ejection cycle, the controller 30 is programmed to appropriately respond to a motor stall.

During a cooling cycle when the ejector members 52 are being utilized as stirrers 51, the stall slot 2162 can be utilized to indicate that the ejector members 52 are either in engagement with or are about to engage the surface of the water in each compartment 66. When the motor 42 is being driven to rotate the ejector arm in the direction of arrow 56, the termination of the stall condition signal indicates to the controller 30 that the ejector members 52 have likely entered the space 104 in the ice forming compartments 66 and are likely in contact with the water surface. When the current invention is implemented using a reversible motor, such as a stepper motor, the controller 30 may then either reverse the direction of the motor 42 or continue to rotate the ejector arm 44 in the direction of the arrow 56 for one or more steps before reversing the direction of the motor 42. When the ejector arm 44, after rotating in the direction of arrow 116 in FIG. 13, is again positioned so that the stall condition signal is present, the controller 30 may again reverse the direction of the motor 42 or allow the motor 42 to continue to rotate the ejector arm 44 in the direction of the arrow 116 for one or more steps, or until the stall condition signal terminates before reversing the direction of the motor 42. This pattern may be continued during the cooling cycle to allow the ejector members 52 to act as stirrers 51 which are partially inserted into and then withdrawn from the water to stir the water to inhibit top down freezing.

By keeping track of winding energization and/or the presence or absence of the stall condition signal when the stepper motor 42 is utilized, the controller 30 can appropriately position the ejector members 52 to act as stirrers 51 while the water is cooling. Alternatively, additional indicia 156 such as slots formed in axially extending wall 2158 could be provided to indicate when the stirrers 51 are in various positions.

The heater slot 2164 is positioned on the cylindrical axially extending wall 2158 of the ejector arm encoder face cam 2154 relative to the emitter sensor to provide an indication that the ejector members 52 have rotated sufficiently into the ice forming compartments 66 to allow the heater to be turned off during an ejection cycle. During a filling cycle, the controller 30 may utilize the signal generated by the sensor when the heater slot 2164 is disposed between the emitter and sensor to control the position of the ejector members 52 within the ice forming compartments 66. During a cooling cycle, when the ejector members 52 are being used as stirrers 51, the controller 30 may utilize the signal generated by the sensor 152 when the heater slot 2164 is disposed between the emitter and sensor to control the position of the ejector members 52 within the ice forming compartments 66. For example the presence of signal from the heater slot being disposed between the emitter and sensor may be utilized as an indication that the stirrer 51 has reached a limit position so that the rotation of the motor 42 may be reversed to begin removal of the stirrer 51 from the compartment 66 when a reversible motor is utilized in the ice maker assembly 10.

While it is within the scope of the current disclosure to use a separate stirring mechanism 51 to stir the water in the ice forming spaces 104 of the ice compartments 66 prior to freezing, the current disclosure describes utilizing an existing ejector member 52 to stir the water during the cooling phase prior to changing into ice.

The illustrated icemaker assembly 10 includes a controller 30 that is implemented at least in part by a microcontroller and memory. While many microcontrollers, microprocessors, integrated circuits, discrete components and memory devices may be utilized to implement controller 30, the illustrated controller utilizes a 72F324-J685 microcontroller from ST Microelectronics and EEPROM memory available as part number ULN2803A from Toshiba America Electronic Components Inc. The disclosed microcontroller receives signals from various sensors and components, such as the ejector arm position sensor 150, the fill level sensor and the ice tray temperature sensor 160, to control various components, such as motor 42, heater 54, and the solenoid operated valve in the water inlet, so that the icemaker assembly 10 operates in the manner described. The microcontroller also reads data from and writes data to the memory. The memory may store energized winding data or motor direction data when a reversible stepper motor is utilized, ejector arm position data, ice tray temperature sensor data and other information useful to the operation of ice maker assembly 10.

By applying a temperature sensor 160 to a surface of the ice tray 20 or in a compartment 66 within the tray 20, it is possible to measure the temperature of the water and use that temperature to determine when to stop stirring. Since it is known that pure water reaches its maximum density at standard pressure at around thirty nine degrees Fahrenheit (4 degrees C.) and it expands upon freezing, it is preferable to continue stirring the water until the temperature is well below thirty nine degrees Fahrenheit (4 degrees Celsius). In one current embodiment of the ice maker assembly 10, the water is stirred until the temperature sensor 160 indicates that the water temperature has been at or below a set point temperature for more than five seconds. In one test location where the purity of the water supply and elevation are such that water freezes below −1.049 C., acceptable ice clarity and shape is obtained by setting the set point at −1.049 C.

It is also known that the rate of change of temperature versus time reaches a knee point as the temperature of liquid water approaches the freezing point or the temperature of frozen ice reaches the melting point because of the latent heat of fusion. This knee point is also reached during thawing and may be much easier to detect during the thawing process when heat is being added to the ice by the ice tray heater 54. In pure water at standard pressure, this knee point is generally between 1 and 0 degree Celsius. However, the precise temperature at which the knee point is observed is based on a variety of parameters including atmospheric pressure and water purity. Thus, it is within the scope of the disclosure to detect the knee point of the water and stop stirring when the temperature of the water during cooling reaches the temperature of a detected knee point or a temperature offset from the knee point. It is within the scope of the disclosure to detect the knee point during the pending cooling cycle, during a previous cooling cycle or during a previous ejection cycle when the tray 20 is being heated by the heater 54.

Using signals from the temperature sensor 160, the controller 30 can maintain a record in memory of prior temperatures to determine when the rate of change of the temperature indicates that the knee point has been reached. When the knee point is determined during a prior ejection cycle, the temperature and rate of change of temperature of the ice are stored in memory while the heater 54 is operating. The knee point is determined during the ejection cycle and stored to determine a set point temperature, at which stirring may be stopped during a subsequent cooling cycle. As previously mentioned, the set point temperature at which stirring is stopped may be offset from the stored value of the knee point temperature.

However, it is also within the scope of the disclosure for the knee point to be established based on prior freeze cycles or during the current freeze cycle. Current implementations of the ice maker assembly simply established a set point value which more or less reflects the anticipated knee point or an offset above the anticipated knee point.

In the illustrated embodiment, during filling an ejector member 52 is disposed in each ice forming compartment 66 in a position, such as those shown, for example, in FIG. 9, 10, 11 or 16, to act as a displacement member 53. In a currently implemented embodiment, following filling and prior to the temperature of the water reaching a set point value, the controller 30 continuously enables the motor to drive the ejector member 44 in the direction of arrow 56 to repeatedly submerge the ejector members 52 in the compartments 66 to stir the water contained therein. Once it is detected that the temperature of the water has reached the set point value, the stirring is discontinued and the controller 30 controls the motor 42 to move the ejector arm 44 to the position shown in FIG. 13. When the stirring is finally discontinued, the temperature across the volume of water will be quite evenly distributed.

In an alternative embodiment wherein a reversible motor is utilized, once the controller 30 detects that all of the compartments 66 are properly filled, the controller 30 controls the motor 42 using feedback from the position sensor 150 to oscillate the ejector member 52 repeatedly between positions such as those shown in FIGS. 11 and 9, FIGS. 11 and 10 or FIGS. 11 and 12 so that the ejector member 52 acts as a stirrer 51 to stir the water as it is cooling. Once it is detected that the temperature of the water has reached the set point value, the stirring is discontinued and the controller 30 controls the motor 42 to move the ejector arm 44 to the position shown in FIG. 13. When the stirring is finally discontinued, the temperature across the volume of water will be quite evenly distributed.

By employing a periodic learning mode within the electronic controller 30 as a part of the control process, a precise temperature at which to cease the stirring may be identified within the scope of the disclosure. The learning process uses the temperature sensor 160 to provide temperature readings at discrete intervals which are compared to identify the knee point at which the rate of change of temperature levels off, which is the point at which the water changes into ice. Precise identification of this temperature allows for variances in the freezing point caused by minerals, atmospheric pressure, and so on. While it is within the scope of the disclosure for the knee point to be determined during each complete cycle of the icemaker assembly 10, the illustrated alternative embodiment only determines the knee point during learning modes which are initiated at selected time intervals. The intervals between learning modes need not be frequent. Preferably the learning mode is initiated frequently enough to compensate for anticipated variances over time in water quality, component tolerances and component drifting. By determining the knee point, a set point temperature very close to the actual freezing temperature can be established so that stirring of the water in the ice tray 20 can be terminated close to the actual freezing point. By terminating stirring close to the actual freezing point, reduction of the bulge and improvements in the appearance of the ice cube 130 formed in icemaker assembly 10 are realized.

Figure 9:
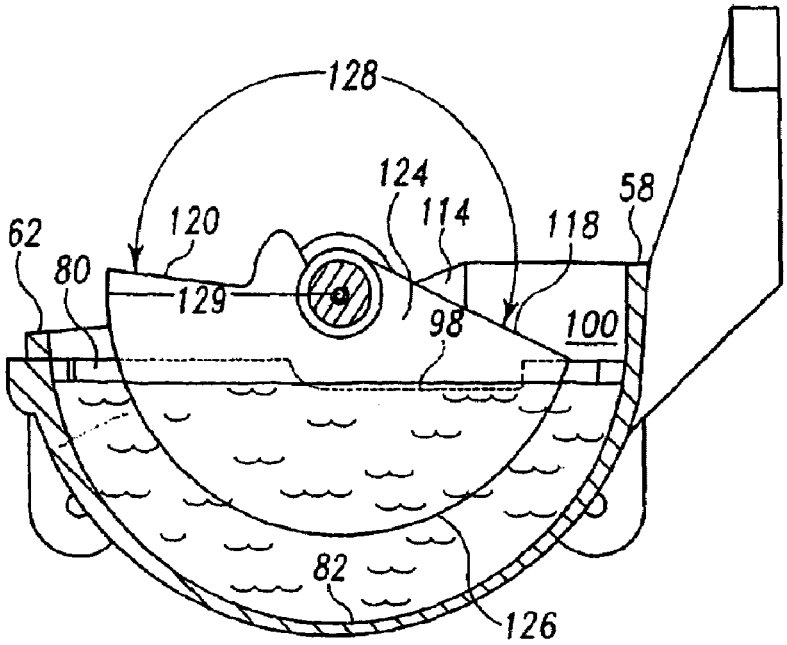
FIG. 9 is a sectional view of the ice tray and ejector arm taken through the rear compartment adjacent the rear end wall looking toward the front end wall during the fill operation showing the ejector arm positioned as shown in FIG. 4 with an ejector member extending into the ice forming space of the compartment to displace water that is flowing over the overflow channel, FIG. 9 also shows a position of the ejector member when it is submerged for use as a stirrer.
Figure 10:
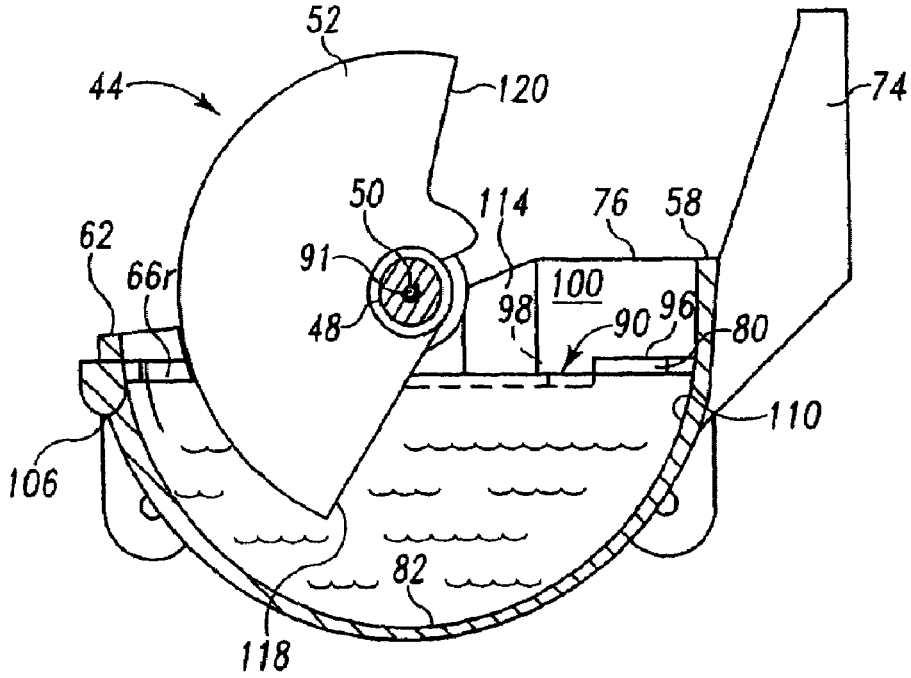
FIG. 10 is a sectional view similar to FIG. 9 showing an alternative position of the ejector arm similar to that shown in FIGS. 2–3 for forming larger ice cubes, FIG. 10 also accurately depicts a stage in the rotation of the ejector arm when it is being repeatedly rotated in a single direction to repeatedly submerge the entire ejector arm to stir the water while cooling and an intermediate or limit position of the ejector arm when it is being advanced into and withdrawn from the compartment to stir the water while cooling.
Figure 11:
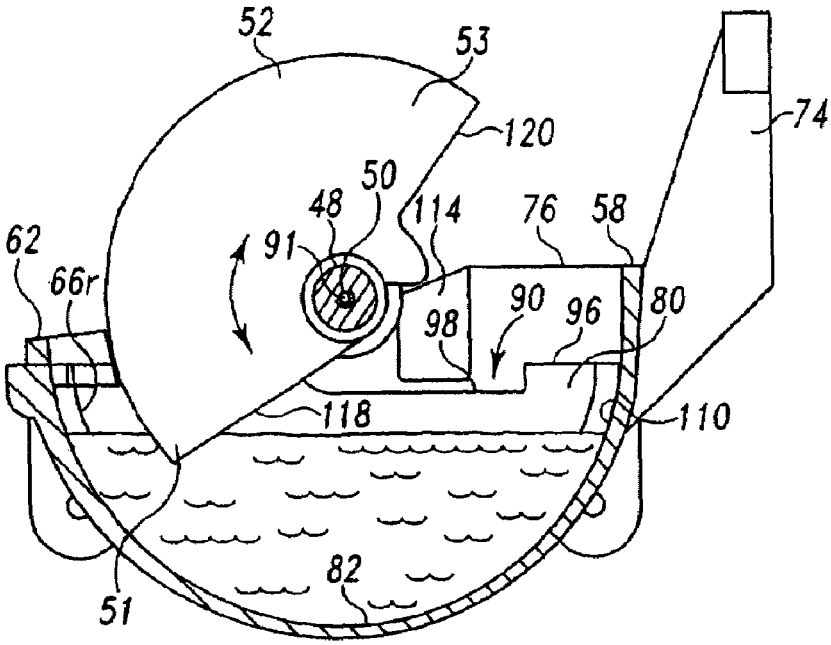
FIG. 11 is a sectional view similar to FIG. 10 after the completion of the filling process showing the ejector member rotated to a position wherein a portion of the ejector arm is disposed below the surface of the water for stirring the water during cooling, the ejector arm may be further rotated into the compartment to a position in which more of the ejector member is submerged in the water or withdrawn from the cavity if only the front face of the ejector member is to be utilized to stir the water while cooling.
Figure 12:
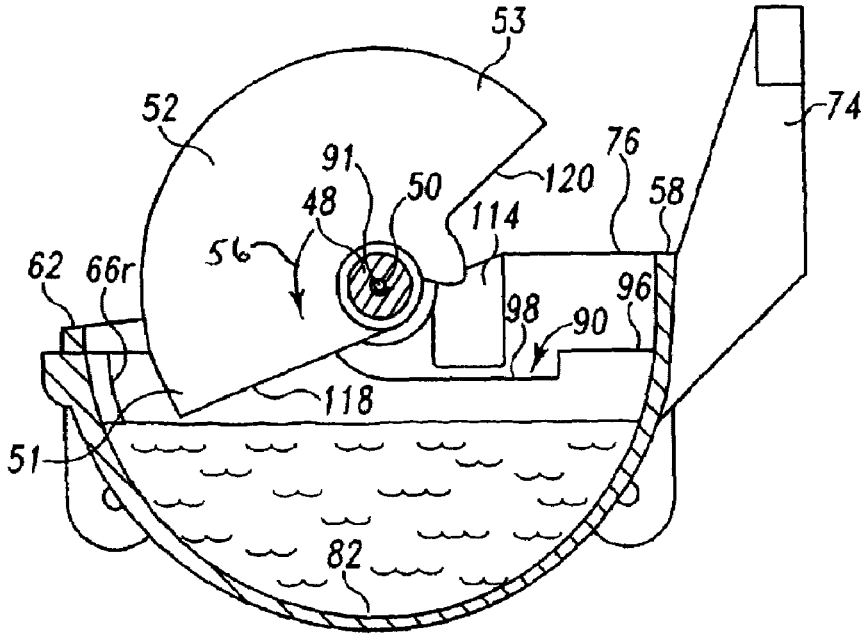
FIG. 12 is a sectional view similar to FIG. 11 showing a second position of a stirring process wherein the ejector member is slightly displaced from the surface of the water in preparation for returning to the position shown in FIG. 9, 10 or 11, the ejector member may be repeatedly cycled between the position shown in FIG. 12 and the positions shown in FIGS. 9, 10 and/or 11 to stir the water in the compartment while the water cools toward the freezing point or the ejector member may be continually rotated in a single direction to pass through the positions illustrated in FIGS. 11, 10 and 9 to stir the water in the compartment while cooling.
Figure 13:
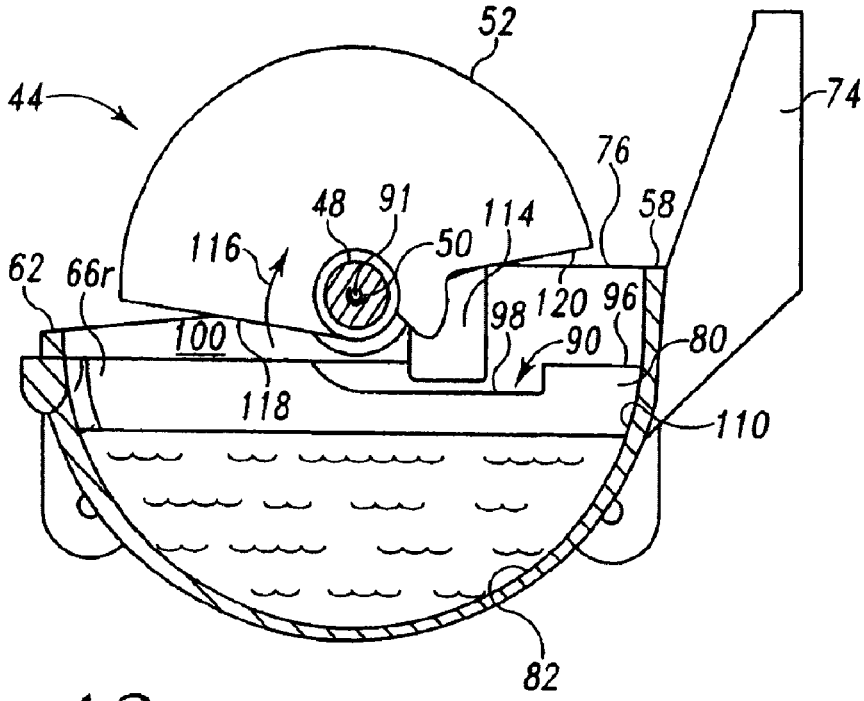
FIG. 13 is a sectional view similar to FIG. 10 following removal of the ejector member from the ice forming space of the compartment prior to ice forming in the compartment, FIG. 13 also accurately depicts a position of the ejector member when it is being continually rotated during cooling to stir the water.

In an unillustrated alternative embodiment, the oscillations of the stirrers 51, as controlled by the controller 30, may be decreased in amplitude, initially oscillating between positions such as those shown in FIGS. 12 and 9 and decreasing to oscillating between positions such as those shown in FIGS. 12 and 11, as the temperature of the water decreases. Also, as the temperature of the water decreases, the frequency of the oscillations would also decrease. Thus, the controller 30 might vary the amplitude and frequency of the oscillations proportional to the amplitude of the signal from the temperature sensor 160 or based on some other control algorithm using the error signal between the sensed temperature and the set point temperature as the control parameter.

By stirring the water prior to freezing, the top surface of the water is inhibited from being the first portion of the water to freeze. Preferably, stirring induces water to be more susceptible to freezing from the bottom up in the tray 20. To the extent that ice might continue to form initially on the top surface of the water, the time difference between the top surface freezing and the remainder of the water freezing is diminished. Without an initial surface layer of ice, or with an initial surface layer forming only briefly before the remainder of the ice freezes, air can continue to escape from the water longer during the freezing process reducing the amount of air trapped in the ice. When less air is trapped in the ice, the resulting ice cubes are clearer. Also, without an initial surface layer of ice, or with an initial surface layer forming only briefly before the remainder of the ice freezes, the bulge on the top surface 132 of the ice cube 130 resulting from expansion of water below the initial surface layer is substantially reduce or eliminated.

Figure 22:
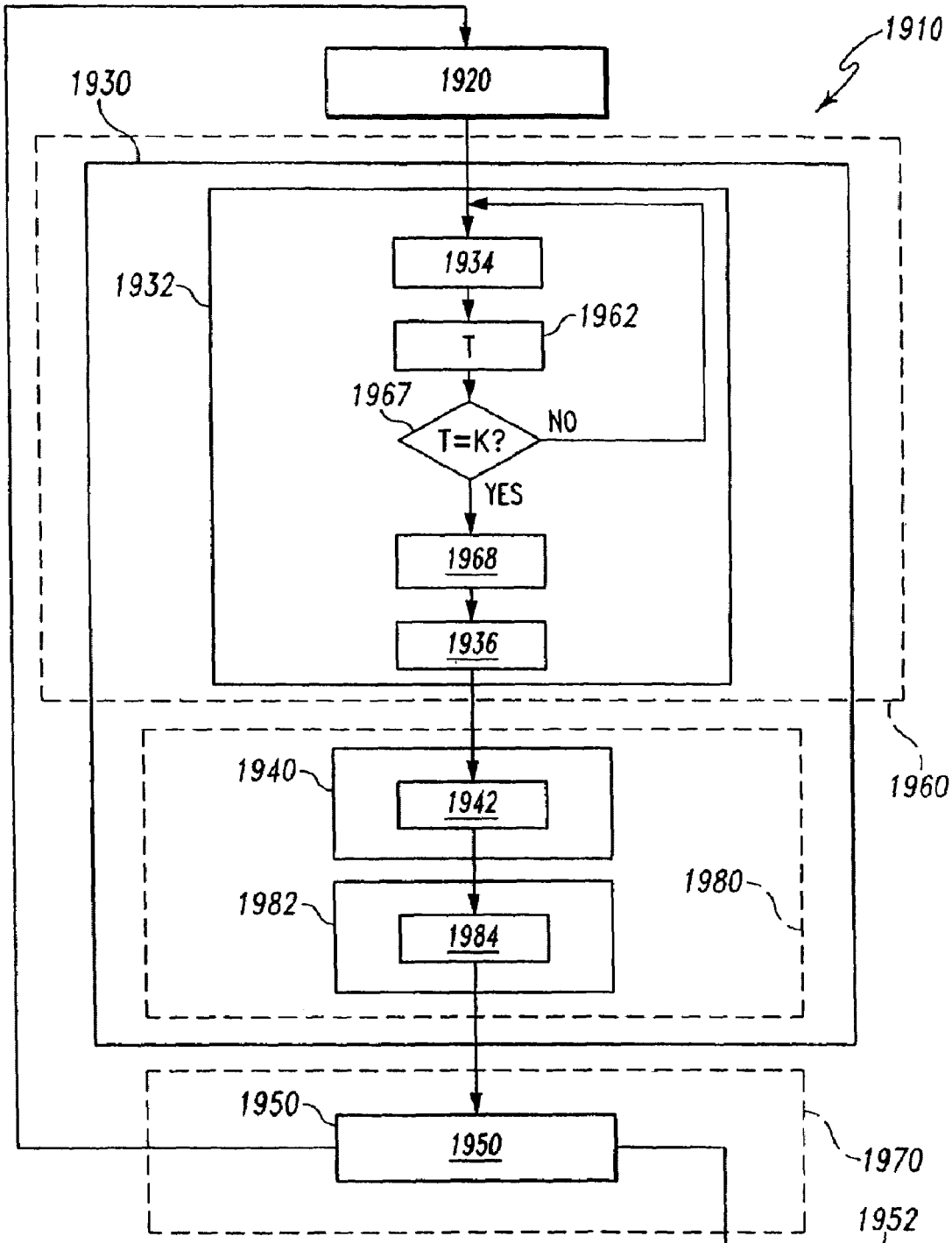
FIG. 22 is a flow diagram of a method of making ice.

As shown, for example, in FIG. 22, a method of making ice 1910 according the present disclosure includes an advancing water step 1920, a reducing step 1930, a stirring step 1932, a moving step 1940 and another advancing step 1950. The advancing water step 1920 includes advancing water into at least one ice forming compartment 66 of an ice tray 20. The reducing step 1930 includes reducing the temperature of the water within the one ice forming compartment 66. The stirring step 1932 is accomplished by stirring the water within the ice forming compartment 66 with an ejector member 52 during the reducing step 1930. The moving step 1940 involves moving the ejector member 52 to a stop position after the stirring step 1932. When in the stop position, the ejector member 52 is spaced apart from the water located in the compartment 66, as shown, for example, in FIG. 13.

During the advancing step 1950, the ejector member 52 is advanced into contact with ice 130 formed in the compartment 66 after the moving step 1940 so that the ice 130 is urged out of the compartment 66. In the illustrated embodiment, during the advancing step 1950, the heater 54 is actuated so that the ice tray 20 and the portions of the ice cubes 130 adjacent the ice tray 20 are heated to induce expansion of the ice tray 20 and melting of a thin layer of the ice adjacent the tray 20.

The ice making method 1910 may also include the step 1982 of maintaining the ejector member at the stop position for a period of time after the ejector member moving step 1940 and before the ejector member advancing step 1950. This period of time is preferably sufficient for the water in the compartment 66 to freeze solid.

In the illustrated embodiment, the stirring step 1932 includes the step 1934 of rotating a shaft 48 having the ejector member 52 secured thereto about an axis of rotation 91. Also, the maintaining step 1982 includes the step 1984 of maintaining the shaft 48 at a stationary position for the period of time after the ejector member moving step 1940 and before the ejector member advancing step 1950. The illustrated method 1910 may also include the step 1962 of sensing the temperature of the water in the ice forming compartment 66 during the temperature reducing step 1930, and generating 1968 a control signal when the temperature reaches a predetermined value 1967. The method 1910 may also include the step 1936 of terminating the stirring step 1932 in response to generation of the control signal. Also, the moving step 1940 may be initiated 1942 in response to generation of the control signal 1968.

The method illustrated in FIG. 22 may be modified by the inclusion of the step 1952 of determining the knee point of the water. The knee point determination step 1952 may be carried out between the temperature sensing step 1962 and the comparison of the sensed temperature to the set point temperature in step 1967. The knee point determination step 1952 may continue following the comparison step 1967 so that the set point temperature may be lowered. The knee point determination step 1952 may be performed during the heater operation of the advancing step 1950. The knee point determination step may be performed every ice production cycle or only during the implementation of periodic learning modes.

During the knee point determination step 1952, temperature sensor 160 senses the temperature of the water or ice cube in step 1954. The sensed temperature is stored for comparison. The stored temperature readings are utilized by the controller 30 to calculate the rate of change of the temperature. As mentioned above, when the rate of temperature change is approximately zero, the knee point has been reached. Thus, when the knee point determination step 1952 is implemented, the controller 30 examines the rate of change of temperature of the water or ice, to see if it is approximately zero in a comparison step 1964. When the rate of change of the temperature is equal to zero, the illustrated embodiment stores the most recent temperature reading as the set point in step 1966 for use during the current cycle or in subsequent cycles as a temperature at which stirring is stopped.

In the illustrated method 1910, when the knee point determination step 1952 is implemented, the predetermined value or set point is equated to the knee point identified. However, those skilled in the art will recognize that the predetermined value or set point may be a value offset from the knee point temperature within the scope of the disclosure.

It is within the scope of the disclosure for ice tray 20 to include more or fewer ice forming compartments 66 so long as it includes at least one ice forming compartment 66. The illustrated ice ejector 22 includes seven ejector members 52 mounted to a single shaft 48 that rotates each of the ejector members 52 into and out of an associated one of the seven illustrated ice forming compartments 66. It is within the scope of the disclosure for the ice ejector 22 to have more or fewer ejector members 52 so long as the ice ejector has at least one ejector member 52. The ice ejector 22 is operable to (i) stir water located within the at least one ice forming compartment 66 with the at least one ejector member 52 during a first mode, and (ii) urge ice 130 out of the at least one ice forming compartment 66 with the at least one ejector member 52 during a second mode.

The disclosed ice maker assembly 10 may include a sensor 160 positioned to sense temperature of water in the least one ice forming compartment 66, as shown, for example, in FIG. 8. The sensor 160 is operable to generate a control signal when the temperature of the water in the at least one ice forming compartment 66 reaches a predetermined value. The ice ejector 22 is operable to terminate operation in the first mode in response to generation of the control signal. The illustrated ice ejector 22 is further operable to initiate operation in the third mode in response to generation of the control signal. The icemaker assembly 10 is operable to (i) identify a knee point of the water in the at least one ice forming compartment 66, and (ii) adjust the predetermined value based on the knee point.

Figure 23:
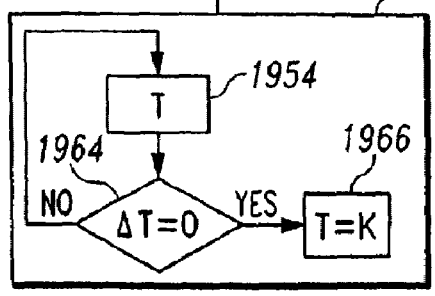
FIG. 23 is a flow diagram of an additional step that may be utilized in the method of FIG. 22 to adjust the set point temperature at which stirring ceases based on a determination of the actual freezing point of the water.

As shown, for example, in FIG. 22, a method of making ice 1910 comprises the steps of operating an ice ejector 22 of an ice maker 10 in a first mode of operation 1960 and operating the ice ejector 22 in a second mode of operation 1970. In the first mode of operation 1960, a plurality of ejector members 52 of the ice ejector 22 are respectively advanced 1934 through water located within a plurality of compartments 66 of an ice tray 20 of the ice maker 10 during cooling 1930 of the water in the ice tray 20. During the second mode of operation 1970, the plurality of ejector members 52 are respectively advanced 1950 into contact with ice 130 formed within the plurality of ice forming compartments 66 so that the ice 130 is urged out of the plurality of ice forming compartments 66. In the illustrated embodiment, the method may also comprise the step 1980 of operating the ice ejector in a third mode of operation in which the plurality of ejector members 52 are maintained 1982 at a stationary position. Illustratively, the third mode operating step 1980 is performed after the first mode operating step 1960 and before the second mode operating step 1970. The first mode operating step 1960 includes the step 1934 of rotating a shaft 48 having the plurality of ejector members 52 secured thereto about an axis of rotation 91. The third mode operating step 1980 includes the step 1984 of maintaining the shaft 48 at a stationary position for a period of time after the first mode operating step 1960 is performed and before the second mode operating step 1970 is performed. In the illustrated embodiment, the method 1910 also includes the step 1962 of sensing the temperature of the water in at least one of the plurality of ice forming compartments 66 during the first mode operating step 1960, and generating 1968 a control signal when the temperature reaches a predetermined value. Illustratively, the first mode operating step 1960 is terminated 1936 in response to generation of the control signal, i.e. when the temperature of the water reaches the predetermined value. The illustrated embodiment 1910 also initiates 1942 the third mode operating step 1980 in response to generation of the control signal. As shown for example in FIG. 23, in the illustrated method a knee point temperature of the water is identified 1964 in at least one of the plurality of ice forming compartments. The predetermined value is adjusted 1966 based on the knee point identified in the identifying step 1964.

Although specific embodiments of the invention have been described herein, other embodiments may be perceived by those skilled in the art without departing from the scope of the invention as defined by the following claims.

What is claimed is:

1. A method of making ice, comprising the steps of:

advancing water into at least one ice forming compartment of an ice tray;

reducing temperature of said water within said at least one ice forming compartment;

stirring said water within said at least one ice forming compartment with a ejector member during said reducing step;

moving said ejector member to a stop position after said stirring step at which said ejector member is spaced apart from said water located in said at least one ice forming compartment; and advancing said ejector member into contact with ice formed in said at least one ice forming compartment after said moving step so that said ice is urged out of said at least one ice forming compartment.

2. The method of claim 1, further comprising the step of maintaining said ejector member at said stop position for a period of time after said ejector member moving step and before said ejector member advancing step.

3. The method of claim 2, wherein:

said stirring step includes the step of rotating a shaft having said ejector member secured thereto about an axis of rotation, and said maintaining step includes the step of maintaining said shaft at a stationary position for said period of time after said ejector member moving step and before said ejector member advancing step.

4. The method of claim 1, further comprising the steps of:

sensing temperature of said water in said at least one ice forming compartment during said temperature reducing step, and generating a control signal when said temperature reaches a predetermined value, and terminating said stirring step in response to generation of said control signal.

5. The method of claim 4, further comprising the step of initiating said moving step in response to generation of said control signal.

6. The method of claim 4, further comprising the steps of:

identifying a knee point of said water in said at least one ice forming compartment, and adjusting said predetermined value based on said knee point identified in said identifying step.

7. An icemaker assembly, comprising:

an ice tray having at least one ice forming compartment; and an ice ejector having at least one ejector member, said ice ejector being operable to (i) stir water located within said at least one ice forming compartment with said at least one ejector member during a first mode, and (ii) urge ice out of said at least one ice forming compartment with said at least one ejector member during a second mode.

8. The icemaker assembly of claim 7, wherein:

said icemaker assembly has a plurality of ice forming compartments that includes said at least one ice forming compartment and additional ice forming compartments, said ice ejector has a plurality of ejector members that include said at least one ejector members and additional ejector members; and said ice ejector is operable to (i) stir water located within said plurality of ice forming compartments with said plurality of ejector members during said first mode, and (ii) urge ice out of said plurality of ice forming compartments with said plurality of ejector members during said second mode.

9. The icemaker assembly of claim 8, wherein:

said ice tray includes an end wall and a plurality of partitions, and at least one of said plurality of ice forming compartments defines an ice forming space between said end wall and one of said plurality of partitions.

10. The icemaker assembly of claim 8, wherein:

said ice tray includes a plurality of partitions, and at least one of said plurality of ice forming compartments defines an ice forming space between a first one of said plurality of partitions and a second one of said plurality of partitions.

11. The ice maker assembly of claim 7, wherein said ice ejector further has (i) a central shaft to which said at least one ejector member is secured, and (ii) a motor having an output shaft coupled to said ejector shaft.

12. The ice maker assembly of claim 7, further comprising a sensor positioned to sense temperature of water in said at least one ice forming compartment, wherein:

said sensor is operable to generate a control signal when said temperature in said at least one ice forming compartment reaches a predetermined value, and said ice ejector is operable to terminate operation in said first mode in response to generation of said control signal.

13. The icemaker assembly of claim 12, wherein said ice ejector is further operable to initiate operation in said second mode in response to generation of said control signal.

14. The icemaker assembly of claim 12, wherein said ice ejector is operable to (i) identify a knee point of said water in said at least one ice forming compartment, and (ii) adjust said predetermined value based on said knee point.

15. A method of making ice, comprising the steps of:

operating an ice ejector of an ice maker in a first mode of operation in which a plurality of ejector members of said ice ejector are respectively advanced through water located within a plurality of compartments of an ice tray of said ice maker during cooling of said water in said ice tray; and operating said ice ejector in a second mode of operation in which said plurality of ejector members are respectively advanced into contact with ice formed within said plurality of ice forming compartments so that said ice is urged out of said plurality of ice forming compartments.

16. The method of making ice of claim 15, further comprising the step of operating said ice ejector in a third mode of operation in which said plurality of ejector members are maintained in at a stationary position, wherein said third mode operating step is performed after said first mode operating step and before said second mode operating step.

17. The method of making ice of claim 16, wherein:

said first mode operating step includes the step of rotating a shaft having said plurality of ejector members secured thereto about an axis of rotation, and said third mode operating step includes the step of maintaining said shaft at a stationary position for a period of time after said first mode operating step is performed and before said second mode operating step is performed.

18. The method of claim 15, further comprising the steps of:

sensing temperature of said water in at least one of said plurality of ice forming compartment during said first mode operating step, and generating a control signal when said temperature reaches a predetermined value, and terminating said first mode operating step in response to generation of said control signal.

19. The method of claim 18, further comprising the step of initiating said second mode operating step in response to generation of said control signal.

20. The method of claim 18, further comprising the steps of:

identifying a knee point of said water in at least one of said plurality of ice forming compartments, and adjusting said predetermined values based on said knee point identified in said identifying step.

* * * * *